US011840766B2

(12) United States Patent
Mariampillai et al.

(10) Patent No.: US 11,840,766 B2
(45) Date of Patent: Dec. 12, 2023

(54) ETCHING METAL USING N-HETEROCYCLIC CARBENES

(71) Applicants: QUEEN'S UNIVERSITY AT KINGSTON, Kingston (CA); UNIVERSITY COURT OF THE UNIVERSITY OF ST. ANDREWS, Fife (GB)

(72) Inventors: Brian E. Mariampillai, Inverary (CA); Abrar R. E. Alrashed, Kingston (CA); Cathleen M. Crudden, Kingston (CA); J. Hugh Horton, Kinston (CA); Christopher J. Baddeley, Fife (GB); Christian R. Larrea, Fife (GB)

(73) Assignees: QUEEN'S UNIVERSITY AT KINGSTON, Kingston (CA); UNIVERSITY COURT OF THE UNIVERSITY OF ST. ANDREWS, Fife (GB)

( * ) Notice: Subject to any disclaimer, the term of this patent is extended or adjusted under 35 U.S.C. 154(b) by 525 days.

(21) Appl. No.: 16/305,915

(22) PCT Filed: Jun. 1, 2017

(86) PCT No.: PCT/CA2017/050665

§ 371 (c)(1),
(2) Date: Nov. 30, 2018

(87) PCT Pub. No.: WO2017/205980

PCT Pub. Date: Dec. 7, 2017

(65) Prior Publication Data

US 2020/0283911 A1 Sep. 10, 2020

Related U.S. Application Data

(60) Provisional application No. 62/344,001, filed on Jun. 1, 2016.

(51) Int. Cl.
*C23F 1/10* (2006.01)

(52) U.S. Cl.
CPC ..... *C23F 1/10* (2013.01)

(58) Field of Classification Search
CPC ..... C23F 1/10; C23F 1/14; C23F 1/18
See application file for complete search history.

(56) References Cited

U.S. PATENT DOCUMENTS 5,173,130 A 12/1992 Kinoshita et al.
2005/0173678 A1 8/2005 Miura et al.
(Continued)

FOREIGN PATENT DOCUMENTS

EP 0428260 5/1991
WO WO-2015024120 A1 * 2/2015 ..... B32B 15/04

OTHER PUBLICATIONS

International Search Report and Written Opinion for corresponding International Application No. PCT/CA2017/050665 filed on Jun. 1, 2017.

*Primary Examiner* — Binh X Tran
(74) *Attorney, Agent, or Firm* — DOWELL & DOWELL, P.C.; Angela Lyon

(57) ABSTRACT

An etchant is described that includes an N-heterocyclic carbene and optionally an appropriate solvent. The etchant was effective at etching a metallic surface having, for example, a metal oxide and/or metal, in both solution phase and vapour-phase. The etchant has been shown to effectively etch oxidized copper and tungsten.

6 Claims, 7 Drawing Sheets

(56) References Cited

U.S. PATENT DOCUMENTS

| | | | | |
|---|---|---|---|---|
| 2009/0004385 | A1* | 1/2009 | Blackwell | H01L 21/28556<br>427/250 |
| 2012/0187087 | A1* | 7/2012 | Ohshiro | C23F 1/18<br>252/79.4 |
| 2012/0312782 | A1* | 12/2012 | Tanaka | H01L 21/32134<br>156/345.21 |

* cited by examiner

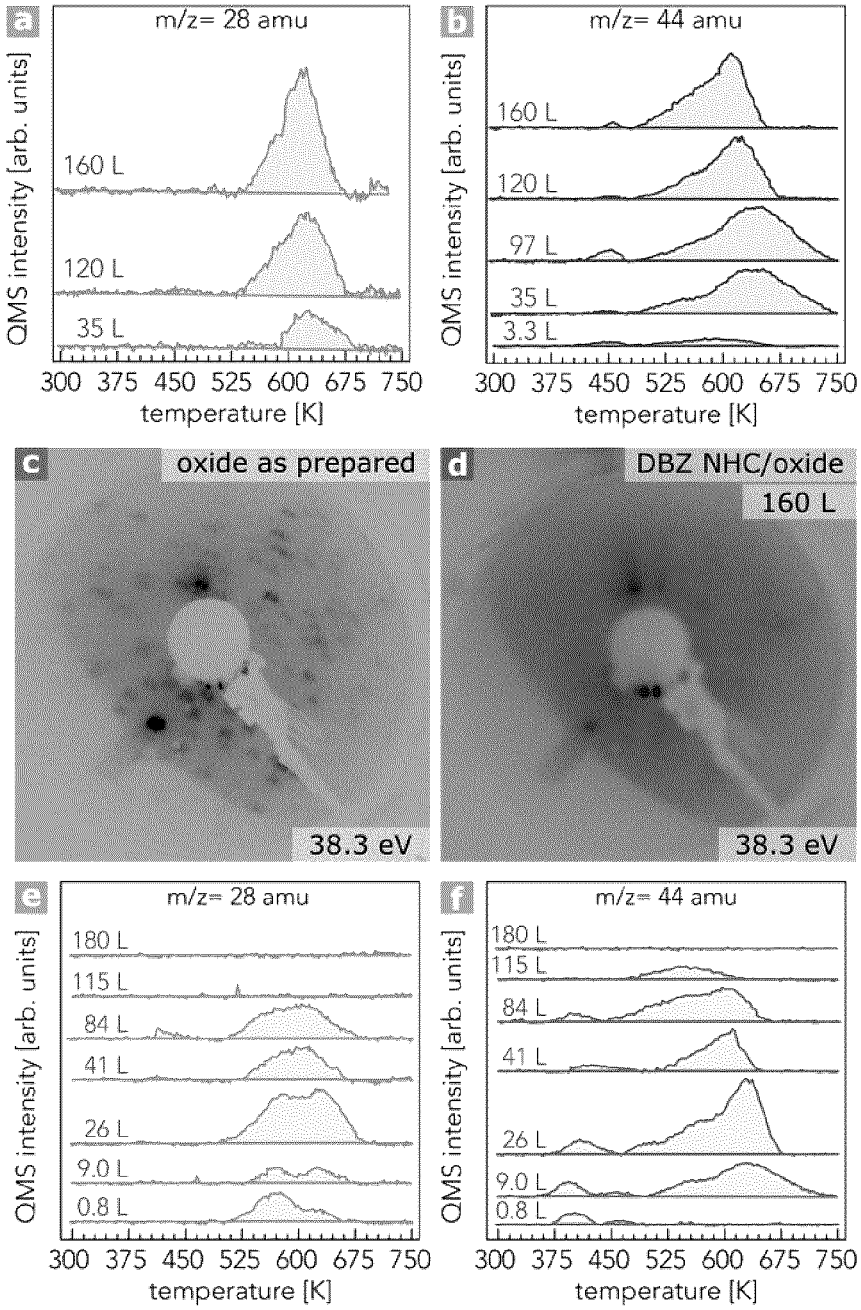
Fig. 5A-F

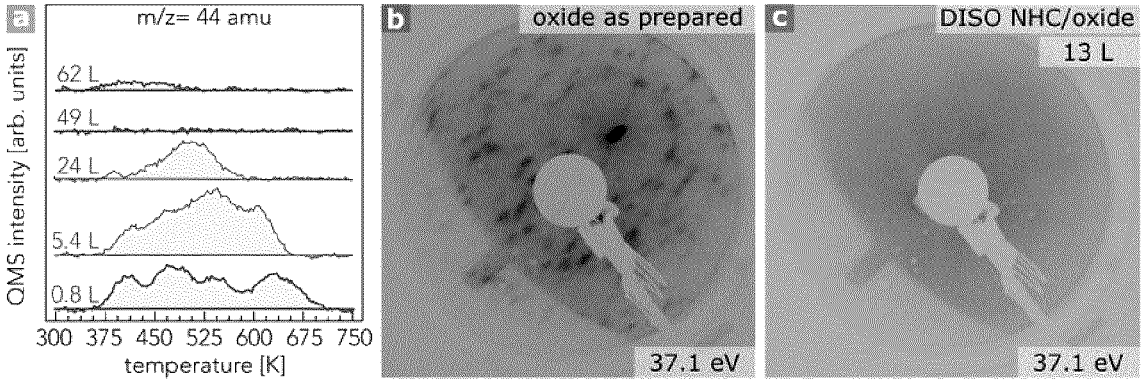
Fig. 6A-C

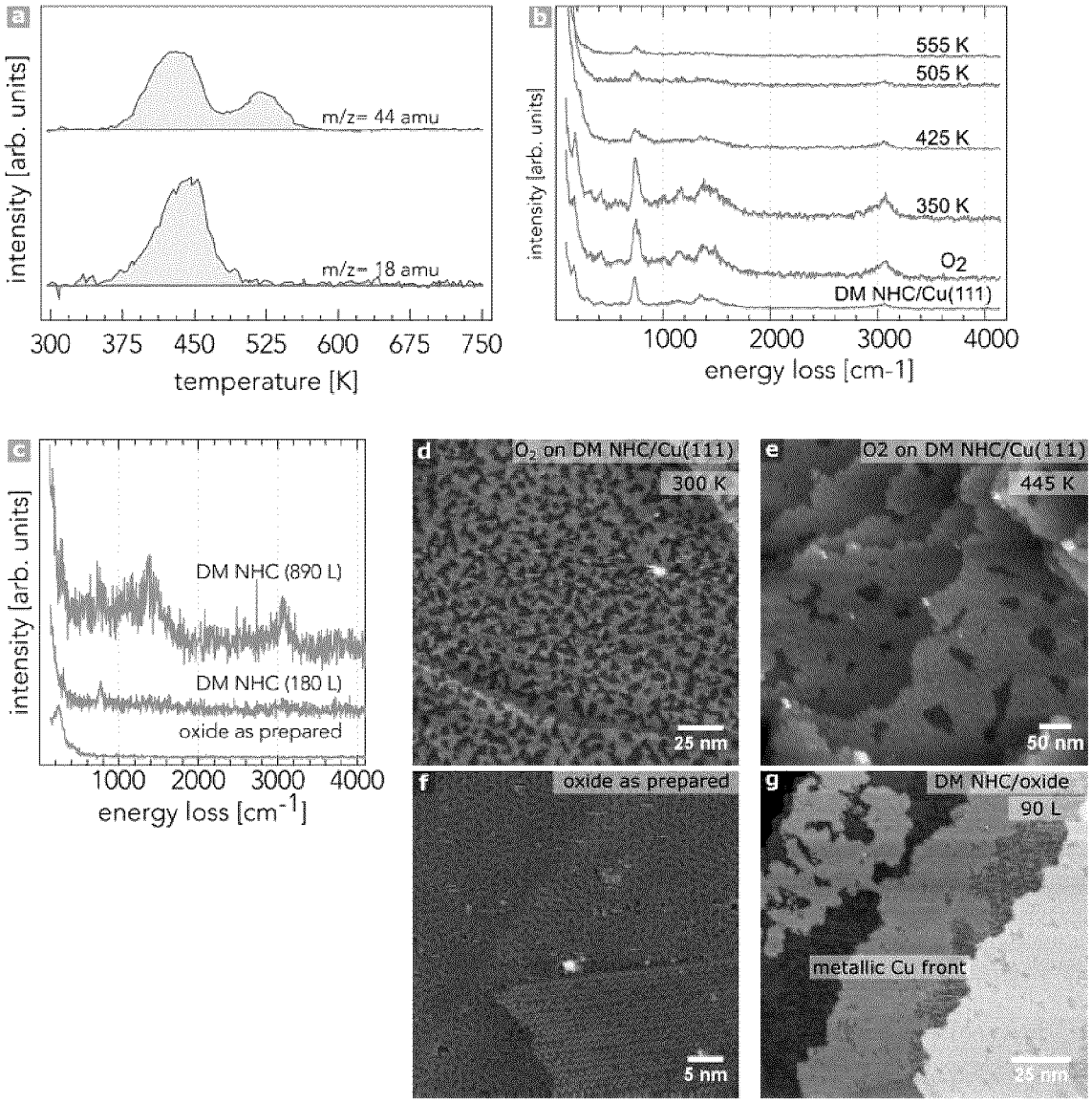
Fig. 7A-G

ETCHING METAL USING N-HETEROCYCLIC CARBENES

FIELD

The application relates to methods of etching metallic surfaces using compounds that include a N-heterocyclic carbene (NHC).

BACKGROUND

Self-assembled monolayers (SAMs) on metals such as gold have potential application in sensing, electrochemistry, drug delivery, surface protection, microelectronics and microelectromechanical systems, among others. Use of self-assembled monolayers (SAMs) as an interface between metal surfaces and organics has had significant impact on molecular electronics, surface patterning techniques and biosensing (R. G. Nuzzo et al., *J. Am. Chem. Soc.* 105, 4481-4483 (1983), C. D. Bain et al., *J. Am. Chem. Soc.* 111, 321-335 (1989), and J. C. Love, et al., Chem. Rev. 105, 1103-1169 (2005)). Examples of robust N-heterocyclic carbene (NHC)-based SAMs with high chemical and electrochemical stability were reported, providing an organic-to-metal linkage with significantly greater robustness than traditional thiol-based SAMs. Unlike most carbenes, which are reactive with limited stability, NHCs typically have one or two heteroatoms adjacent to a carbene carbon. These heteroatoms increase NHCs' stability such that they can usually be prepared on a gram scale, crystallized, distilled, and stored for longer periods of time (e.g., 4 years, when stored under $N_2$ in a freezer). Application of these carbenes in materials science, and other fields outside of homogeneous catalysis, has been limited (L. Mercs, et al., *Chem. Soc. Rev.* 39, 1903 (2010)).

An essential step in the microelectronics manufacturing process is the removal of surface residues. Cleaning techniques for silicon or aluminum wafer surfaces are known. However, compounds that are effective in etching oxide residues from a metal substrate are needed.

SUMMARY

In a first aspect, there is provided an etchant or an etching solution for etching a metallic surface (e.g., metal oxide), comprising a compound of general formula (II), (IIa), (III), (IIIa), (IV), (IVa) or (VI)

(II)

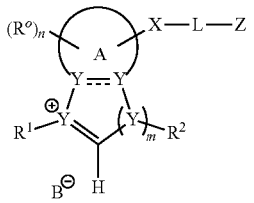

(IIa)

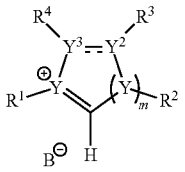

-continued (III)

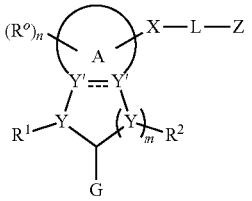

(IIIa)

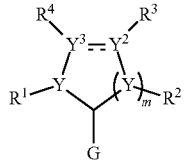

(IV)

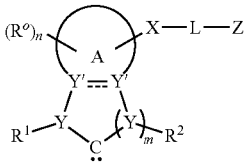

(IVa)

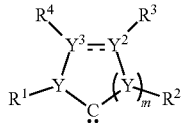

(VI)

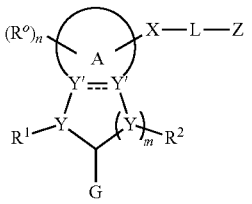

wherein n is an integer from 1 to 8, or from 1 to 4;

m is an integer from 0 to 4;

A is absent, an aliphatic cycle, a heterocycle, an aromatic ring, a fused aromatic ring system, a heteroaromatic ring, and/or a fused heteroaromatic ring system, each of which is optionally substituted;

B is a counter ion that optionally acts as a base;

G is a perhalogenated alkyl, perhalogenated alkenyl, perhalogenated alkynyl, a perhalogenated aryl, or OR', wherein R' is an aliphatic group, for example, an alkyl group; Y, Y', $Y^2$ and $Y^3$ are independently C or a heteroatom, and the dashed line is an optional double bond;

X-L-Z is absent, or

X is C or a heteroatom;

L is a divalent moiety, such as $C_1$-$C_{10}$ alkylene, $C_{10}$-$C_{20}$ alkylene, $C_1$-$C_{10}$ alkenylene, $C_{10}$-$C_{20}$ alkenylene, $C_1$-$C_{10}$ alkynylene, $C_{10}$-$C_{20}$ alkynylene, or dextran, a simple sugar, complex sugar, carbohydrate, ether, thioether, amine, polyamine, polyether, and/or polythioether, each of which is optionally substituted;

Z is H, an aliphatic cycle, a heterocycle, an aromatic ring, a fused aromatic ring system, a heteroaromatic ring, a fused heteroaromatic ring system, an N-heterocyclic carbene hydrogen precursor, an organometallic complex, a transition-metal catalyst, a metal-oxide catalyst, a simple sugar, a complex sugar, a carbohydrate, or a chemically derivatizable group, such as hydroxyl (—OH), azide, carboxylic acid, carbonyl chloride, anhydride, ester, aldehyde, alcohol, amine, halogen, epoxide, thiirane, aziridine, amino acid, nucleic acid, alkene, alkyne, conjugated diene, thiol, or thioester, each of which is optionally substituted each $R^o$ is independently H, halogen, the substituent X-L-Z as defined above, $C_1$-$C_{10}$ alkyl, $C_{10}$-$C_{20}$ alkyl, $C_1$-$C_{10}$ alkenyl, $C_{10}$-$C_{20}$ alkenyl, $C_1$-$C_{10}$ alkynyl, $C_{10}$-$C_{20}$ alkynyl, $C_1$-$C_{10}$ alkoxyl, $C_{10}$-$C_{20}$ alkoxyl, $C_3$-$C_{20}$ cyclic aliphatic moiety, aryl, heteroaryl, ether, thioether, amine, polyamine, polyether, or polythioether, each of which is optionally substituted; or, two of $R^o$, together with the atoms to which they are attached, are connected to form a cycle, heterocycle, or an N-heterocyclic carbene precursor, each of which is optionally substituted;

$R^1$ and $R^2$ are independently absent, at least one lone pair of electrons, H, the substituent X-L-Z as defined above, $C_1$-$C_{10}$ alkyl, $C_{10}$-$C_{20}$ alkyl, branched $C_1$-$C_{10}$ alkyl, $C_1$-$C_{10}$ alkenyl, $C_{10}$-$C_{20}$ alkenyl, $C_1$-$C_{10}$ alkynyl, or $C_{10}$-$C_{20}$ alkynyl, $C_3$-$C_{20}$ cyclic aliphatic moiety, aryl, benzyl, polycyclic aryl, polycyclic benzyl, heteroaryl, ether, thiol, thioether, amine, polyamine, polyether, polythioether, or polythiol, each of which is optionally substituted; or, one of $R^1$ or $R^2$, with one of $R^o$, together with the atoms to which they are attached, are connected to form a cycle, or heterocycle, each of which is optionally substituted;

$R^3$ and $R^4$ are independently H, halogen, the substituent X-L-Z as defined above, $C_1$-$C_{10}$ alkyl, $C_{10}$-$C_{20}$ alkyl, $C_1$-$C_{10}$ alkenyl, $C_{10}$-$C_{20}$ alkenyl, $C_1$-$C_{10}$ alkynyl, $C_{10}$-$C_{20}$ alkynyl, $C_1$-$C_{10}$ alkoxyl, $C_{10}$-$C_{20}$ alkoxyl, $C_3$-$C_{20}$ cyclic aliphatic, aryl, heteroaryl, ether, thio, thioether, amine, polyamine, polyether, polythioether, or polythiol, each of which is optionally substituted; or, any one of $R^3$ or $R^4$, with any one of $R^1$ or $R^2$, together with the atoms to which they are attached, are connected to form a cycle, or heterocycle, each of which is optionally substituted; or, $R^3$ and $R^6$, together with the atoms to which they are attached, are connected to form a cycle, heterocycle, or an N-heterocyclic carbene precursor, each of which is optionally substituted; and, optionally, a solvent.

In a second aspect, there is provided a method of etching a metallic surface of a workpiece, comprising contacting the metallic surface with an etchant or an etching solution of the first aspect.

In a third aspect, there is provided an etched substrate obtained by the method of the second aspect.

In a fourth aspect, there is provided a process for manufacturing an electronic component (e.g., circuit board) which comprises the steps of bonding a metal (e.g., foil) to a substrate, exposing at least a portion of the metal to the etchant or etching solution of the first aspect thereby removing metal oxide and/or metal from the exposed portion of the metal.

In another aspect, there is provided a process for manufacturing an electronic component or semi-conductor device comprising providing a metallic surface, exposing at least a portion of the metallic surface to the etchant or etching solution of the first aspect thereby removing metal oxide and/or metal from the exposed portion of the metallic surface.

In a fifth aspect, there is provided any of the above aspects wherein the compound of general formulas (II), (IIa), or (IVa) is:

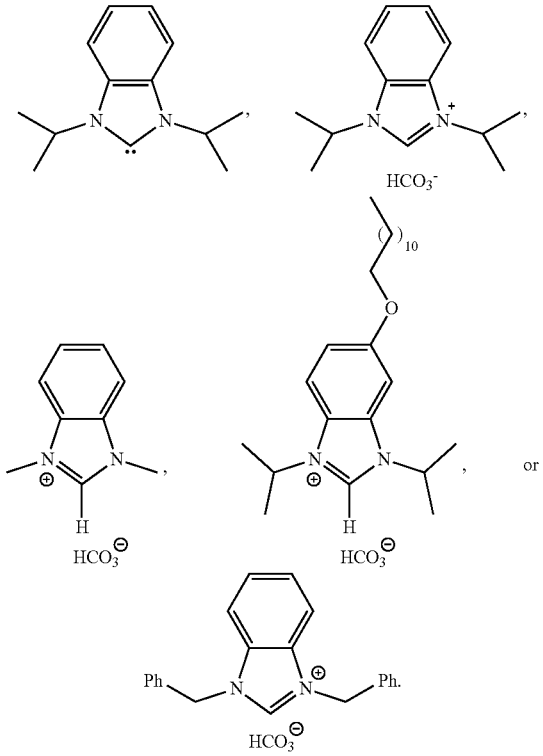

In an embodiment of the second aspect, the etching is part of a chemical mechanical planarization polishing method or an atomic layer etching method. In an embodiment of the second aspect, the etched material is both oxide and metal. In an embodiment of the second aspect, the metallic surface comprises copper, tungsten, and/or silver.

In an embodiment of the above method, the etchant is a solution. In an embodiment of the above method, the etchant is a solid. In an embodiment of the above method, the contacting the metallic surface is a solution phase process. In an embodiment of the above method, the contacting the metallic surface is a vapour phase process.

BRIEF DESCRIPTION OF THE DRAWINGS

For a better understanding of the present application and to show more clearly how it may be carried into effect, reference will now be made by way of example to the accompanying drawings, which illustrate aspects and features according to preferred embodiments of the present application, and in which:

FIG. 3 shows a Cu Auger LMM Spectra as a function of photoelectron kinetic energy (x-axis). Trace A shows a Cu Auger LMM spectra for Cu foil that has undergone an acetate cleaning process to remove any surface oxide. Trace B shows the same surface exposed to 2a. Trace C shows the same surface exposed to 3a.

FIG. 4 shows a Cu Auger LMM Spectra as a function of photoelectron kinetic energy (x-axis), wherein Trace D shows the Auger spectra for Cu foil which has undergone an oxidation process to form a surface oxide film. Trace E shows the same surface exposed to 2a. Trace F shows the same surface exposed to 3a.

FIG. 5*a* graphically shows quadrupole mass spectrometer (QMS) spectra as a function of temperature for the region of m/z 28 amu (CO region) after depositing the dibenzyl NHC on copper oxide for the specified pressure and time (in Longmuir units (L)).

FIG. 5*b* graphically shows quadrupole mass spectrometer (QMS) spectra as a function of temperature for the region of m/z 44 amu ($CO_2$ region) after depositing the dibenzyl NHC on copper oxide for the specified pressure and time (in Longmuir units (L)).

FIG. 5*c* shows a LEED pattern for oxide, which was prepared by heating Cu(111) at 675 K in $O_2$ atmosphere ($P=1\times10^{-6}$ to $1\times10^{-5}$ mbar) for 20 minutes, followed by heating to 800 K for 10 minutes under UHV.

FIG. 5*d* shows a LEED pattern after depositing dibenzyl NHC on the copper oxide.

FIG. 5*e* graphically shows quadrupole mass spectrometer (QMS) spectra as a function of temperature for the region of m/z 28 amu (CO region) for dibenzyl NHC-covered Cu(111) prepared by depositing the dibenzyl NHC for the specified pressure and time (in Longmuir units (L)) followed by $O_2$ exposure (~990 L).

FIG. 5*f* graphically shows QMS spectra as a function of temperature for the region of m/z 44 amu ($CO_2$ region) for dibenzyl NHC-covered Cu(111) prepared by depositing the dibenzyl NHC for the specified pressure and time (in Longmuir units (L)) followed by $O_2$ exposure (~990 L).

FIG. 6*a* graphically shows QMS spectra as a function of temperature for the region of m/z 44 amu ($CO_2$ region) for diisopropyl NHC-covered Cu(111) prepared by depositing the diisopropyl NHC for the specified pressure and time (in Longmuir units (L)) followed by $O_2$ exposure (~990 L).

FIG. 6*b* shows a LEED pattern of the oxide, which was prepared by heating Cu(111) at 675 K in $O_2$ atmosphere ($P=1\times10^{-6}$ to $1\times10^{-5}$ mbar) for 20 minutes, followed by heating to 800 K for 10 minutes under UHV.

FIG. 6*c* shows a LEED pattern after depositing diisopropyl NHC ("DISO NHC") on the copper oxide.

FIG. 7*a* graphically shows QMS spectra as a function of temperature for the regions of m/z 28 amu (CO region) and m/z 44 amu ($CO_2$ region) of a dimethyl NHC-covered Cu(111) prepared by depositing the dimethyl NHC for 400 Longmuirs and exposed to $O_2$ for approximately 990 L.

FIG. 7*b* shows HREELS spectra of dimethyl NHC-covered Cu(111) (prepared by depositing the dimethyl NHC for 270 Longmuirs) and exposed to $O_2$ for approximately 990 L and annealed to the stated temperatures.

FIG. 7*c* shows HREELS spectra of the oxide (prepared by heating Cu(111) at 675 K in $O_2$ atmosphere ($P=1\times10^{-6}$ to $1\times10^{-5}$ mbar) for 20 minutes followed by heating to 800 K for 10 minutes under UHV) and dimethyl NHC ("DM NHC") dosed on the oxide for 180 Longmuirs or 890 Longmuirs exposure as specified.

FIG. 7*d* shows a scanning tunnelling microscopy (STM) image (180 nm×180 nm) of a Cu(111) surface that has been exposed to dimethyl NHC (2200 Longmuirs at 300 K) and subsequently exposed to oxygen (~990 L) and heated to 300 K, where dark areas are oxidized regions, while the areas with lighter contrast correspond to metallic regions of the surface.

FIG. 7*e* shows an STM image (500 nm×500 nm) of a Cu(111) surface that has been exposed to dimethyl NHC (2200 Longmuirs at 300 K) and subsequently exposed to oxygen (~990 Longmuirs) and heated to 445 K, where heating caused a dramatic reduction in the ratio of dark (oxidized) to bright (metallic) regions of the surface.

FIG. 7*f* shows a high resolution STM image (50 nm×50 nm) of the oxidised Cu(111) surface. The oxide was prepared by heating the Cu(111) sample at 675 K in $O_2$ atmosphere ($P=1\times10^{-6}$ to $1\times10^{-5}$ mbar) for 20 minutes, followed by heating to 800 K for 10 minutes under UHV, where two different ordered oxide structures can be observed with high resolution.

FIG. 7g shows an STM image (140 nm×140 nm) of the oxidized Cu(111) surface after exposure to 90 Longmuirs of dimethyl NHC at 300 K, where residual oxidized regions appear as dark areas and large brighter (metallic) regions are formed close to step edges on the upper terraces.

DETAILED DESCRIPTION

Definitions

Figure 1:
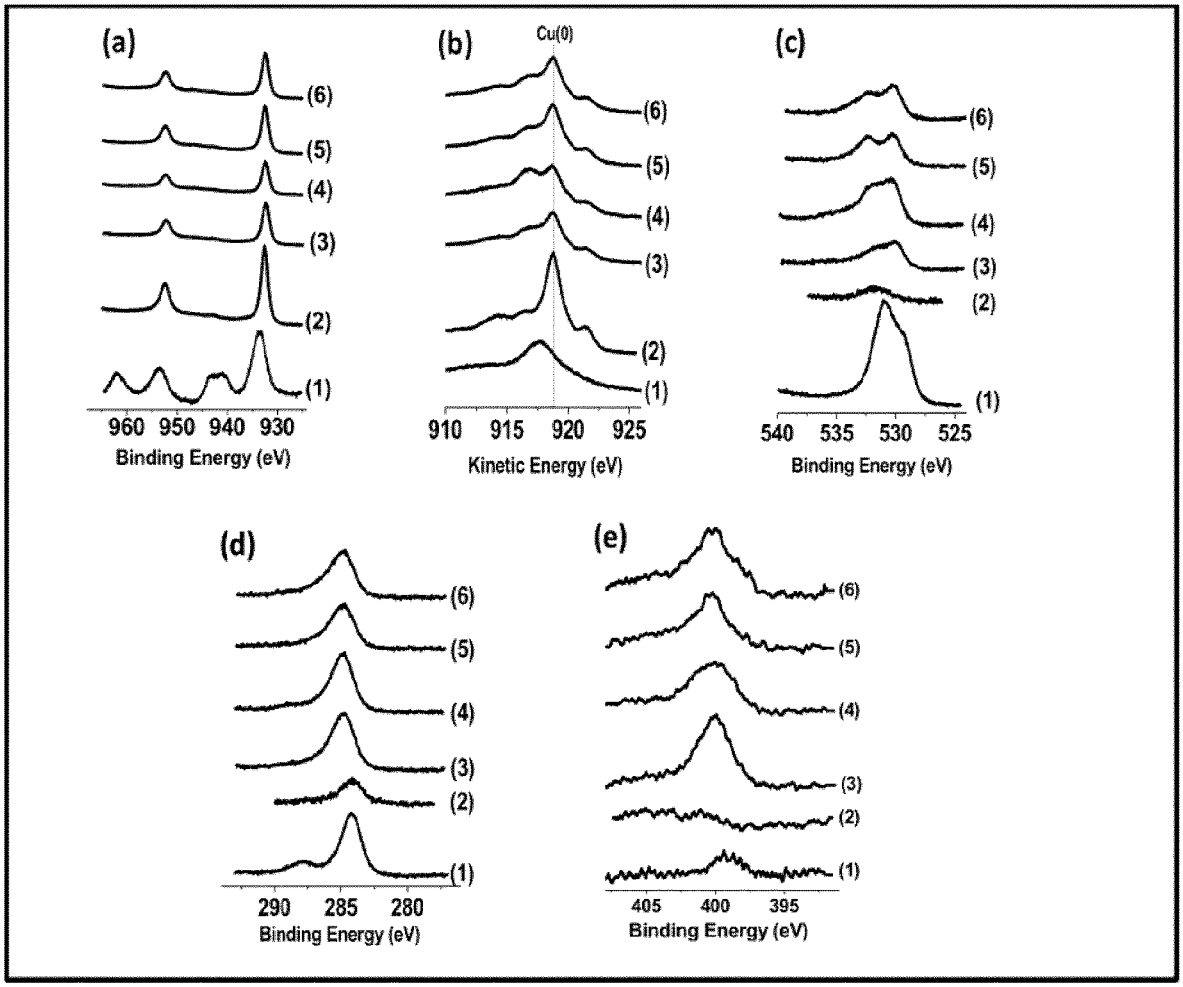
FIG. 1A shows a plot of XPS spectra of Cu(2p) plotting binding energy vs. relative intensity, where trace 1 is oxidized Cu with no NHC treatment, trace 2 is oxide-free Cu with no NHC treatment, trace 3 is oxide-free Cu after treatment with NHC (2a), trace 4 is oxidized Cu after treatment with NHC (2a), trace 5 is oxide-free Cu after treatment with NHC salt (3a), and trace 6 is oxidized Cu after treatment with NHC salt (3a).
FIG. 1B shows a plot of XPS spectra of Auger Cu(LMM) plotting kinetic energy vs. relative intensity, where trace 1 is oxidized Cu with no NHC treatment, trace 2 is oxide-free Cu with no NHC treatment, trace 3 is oxide-free Cu after treatment with NHC (2a), trace 4 is oxidized Cu after treatment with NHC (2a), trace 5 is oxide-free Cu after treatment with NHC salt (3a), and trace 6 is oxidized Cu after treatment with NHC salt (3a).
FIG. 1C shows a plot of XPS spectra of O(1s) plotting binding energy vs. relative intensity, where trace 1 is oxidized Cu with no NHC treatment, trace 2 is oxide-free Cu with no NHC treatment, trace 3 is oxide-free Cu after treatment with NHC (2a), trace 4 is oxidized Cu after treatment with NHC (2a), trace 5 is oxide-free Cu after treatment with NHC salt (3a), and trace 6 is oxidized Cu after treatment with NHC salt (3a).
FIG. 1D shows a plot of XPS spectra of C(1s) plotting binding energy vs. relative intensity, where trace 1 is oxidized Cu with no NHC treatment, trace 2 is oxide-free Cu with no NHC treatment, trace 3 is oxide-free Cu after treatment with NHC (2a), trace 4 is oxidized Cu after treatment with NHC (2a), trace 5 is oxide-free Cu after treatment with NHC salt (3a), and trace 6 is oxidized Cu after treatment with NHC salt (3a).
FIG. 1E shows a plot of XPS spectra of N(1s) plotting binding energy vs relative intensity, where trace 1 is oxidized Cu with no NHC treatment, trace 2 is oxide-free Cu with no NHC treatment, trace 3 is oxide-free Cu after treatment with NHC (2a), trace 4 is oxidized Cu after treatment with NHC (2a), trace 5 is oxide-free Cu after treatment with NHC salt (3a), and trace 6 is oxidized Cu after treatment with NHC salt (3a).

Unless defined otherwise, all technical and scientific terms used herein have the same meaning as commonly understood by one of ordinary skill in the art to which this invention belongs.

As used in the specification and claims, the singular forms "a", "an" and "the" include plural references unless the context clearly dictates otherwise.

The term "comprising" as used herein will be understood to mean that the list following is non-exhaustive and may or may not include any other additional suitable items, for example one or more further feature(s), component(s) and/or ingredient(s) as appropriate.

The term "etch" as used herein will be understood to mean to wear away the surface of a metal by chemical action.

As used herein, the term "substituted" means having one or more substituent moieties whose presence either facilitates or improves the desired reaction, or does not impede the desired reaction. A "substituent" is an atom or group of bonded atoms that can be considered to have replaced one or more hydrogen atoms attached to a parent molecular entity. Examples of substituents include alkyl, alkenyl, alkynyl, aryl, aryl-halide, heteroaryl, cycloalkyl (non-aromatic ring), $Si(alkyl)_3$, $Si(alkoxy)_3$, halo, alkoxyl, amino, alkylamino, alkenylamino, amide, amidine, hydroxyl, thioether, alkylcarbonyl, alkylcarbonyloxy, arylcarbonyloxy, alkoxycarbonyloxy, aryloxycarbonyloxy, carbonate, alkoxycarbonyl, aminocarbonyl, alkylthiocarbonyl, phosphate, phosphate ester, phosphonato, phosphinato, cyano, acylamino, imino, sulfhydryl, alkylthio, arylthio, thiocarboxylate, dithiocarboxylate, sulfate, sulfato, sulfonate, sulfamoyl, sulfonamide, nitro, nitrile, azido, heterocyclyl, ether, ester, silicon-containing moieties, thioester, or a combination thereof. The substituents may themselves be substituted. For instance, an amino substituent may itself be mono or independently disubstituted by further substituents defined above, such as alkyl, alkenyl, alkynyl, aryl, aryl-halide and heteroaryl cycloalkyl (non-aromatic ring).

As used herein, "aliphatic" refers to hydrocarbon moieties that are linear, branched or cyclic, may be alkyl, alkenyl or alkynyl, and may be substituted or unsubstituted.

As used herein, "alkyl" refers to a linear, branched or cyclic, saturated hydrocarbon, which consists solely of single-bonded carbon and hydrogen atoms, which can be unsubstituted or is optionally substituted with one or more substituents, for example a methyl or ethyl group. Examples of saturated straight or branched chain alkyl groups include, but are not limited to, methyl, ethyl, 1-propyl, 2-propyl, 1-butyl, 2-butyl, 2-methyl-1-propyl, 2-methyl-2-propyl, 1-pentyl, 2-pentyl, 3-pentyl, 2-methyl-1-butyl, 3-methyl-1-butyl, 2-methyl-3-butyl, 2,2-dimethyl-1-propyl, 1-hexyl, 2-hexyl, 3-hexyl, 2-methyl-1-pentyl, 3-methyl-1-pentyl, 4-methyl-1-pentyl, 2-methyl-2-pentyl, 3-methyl-2-pentyl, 4-methyl-2-pentyl, 2,2-dimethyl-1-butyl, 3,3-dimethyl-1-butyl and 2-ethyl-1-butyl, 1-heptyl and 1-octyl. As used herein the term "alkyl" encompasses cyclic alkyls, or cycloalkyl groups.

The term "cycloalkyl" as used herein refers to a non-aromatic, saturated or partially saturated, monocyclic, bicyclic or tricyclic hydrocarbon ring system containing at least 3 carbon atoms. Examples of $C_3$-$C_n$ cycloalkyl groups include, but are not limited to, cyclopropyl, cyclobutyl, cyclopentyl, cyclohexyl, cycloheptyl, cyclooctyl, norbornyl, adamantyl, bicycle[2.2.2]oct-2-enyl, and bicyclo[2.2.2]octyl.

As used herein, "alkenyl" means a hydrocarbon moiety that is linear, branched or cyclic and comprises at least one carbon to carbon double bond which can be unsubstituted or substituted with one or more substituents. "Alkynyl" means a hydrocarbon moiety that is linear, branched or cyclic and comprises at least one carbon to carbon triple bond which can be unsubstituted or substituted with one or more substituents.

As used herein, "aryl" and/or "aromatic ring" refers to hydrocarbons derived from benzene or a benzene derivative that are unsaturated aromatic carbocyclic groups from 6 to 100 carbon atoms, or from which may or may not be a fused ring system, in some embodiments 6 to 50, in other embodiments 6 to 25, and in still other embodiments 6 to 15. The aryls may have a single or multiple rings. The term "aryl" and/or "aromatic ring" as used herein also includes substituted aryls and/or aromatic rings. Examples include, but are not limited to, phenyl, naphthyl, xylene, phenylethane, substituted phenyl, substituted naphthyl, substituted xylene, substituted 4-ethylphenyl and the like.

As used herein, a workpiece refers to an object that is being worked on.

As used herein, the term "Auger" is coined from the Auger effect, which is based on analysis of energetic electrons emitted from an atom following initial excitation of a photoelectron and a subsequent series of internal relaxation events. In XPS analysis, "Auger Cu" refers to analysis of energetic electrons arising from the Auger effect and that are other than the primary photoelectron excitation, thus such spectra differ from XPS Cu(2p).

As used herein, a "metal film" refers to a metal layer that has lateral dimensions (i.e., thickness) in the range of 0.1-100 nm, or alternatively 0.1-100 μm, or alternatively >100 μm.

As used herein, "copper", "polycrystalline copper", or "copper foil" refers to a copper sample of a particular size (e.g., 1 cm×1 cm with a thickness of 1 mm). Such samples include a variety of crystal packing lattices of copper atoms.

As used herein, "cycle" refers to an aromatic or nonaromatic monocyclic, bicyclic, or fused ring system of carbon atoms, which can be substituted or unsubstituted. Included within the term "cycle" are cycloalkyls and aryls, as defined above.

As used herein, "heteroaryl" or "heteroaromatic" refers to an aryl (including fused aryl rings) that includes heteroatoms selected from oxygen, nitrogen, sulfur and phosphorus. A "heteroatom" refers to an atom that is not carbon or hydrogen, such as nitrogen, oxygen, sulfur, or phosphorus. Heteroaryl or heteroaromatic groups include, for example, furanyl, thiophenyl, pyrrolyl, imidazoyl, benzamidazoyl, 1,2- or 1,3-oxazolyl, 1,2- or 1,3-diazolyl, 1,2,3- or 1,2,4-triazolyl, and the like.

As used herein, a "heterocycle" is an aromatic or nonaromatic monocyclic or bicyclic ring of carbon atoms and heteroatoms selected from oxygen, nitrogen, sulfur and phosphorus. Included within the term "heterocycle" are heteroaryls, as defined above. Also included within this term are monocyclic and bicyclic rings that include one or more double and/or triple bonds within the ring. Examples of 3- to 9-membered heterocycles include, but are not limited to, aziridinyl, oxiranyl, thiiranyl, azirinyl, diaziridinyl, diazirinyl, oxaziridinyl, azetidinyl, azetidinonyl, oxetanyl, thietanyl, piperidinyl, piperazinyl, morpholinyl, pyrrolyl, oxazinyl, thiazinyl, diazinyl, triazinyl, tetrazinyl, imidazolyl, benzimidazolyl, tetrazolyl, indolyl, isoquinolinyl, quinolinyl, quinazolinyl, pyrrolidinyl, purinyl, isoxazolyl, benzisoxazolyl, furanyl, furazanyl, pyridinyl, oxazolyl, benzoxazolyl, thiazolyl, benzthiazolyl, thiophenyl, pyrazolyl, triazolyl, benzodiazolyl, benzotriazolyl, pyrimidinyl, isoindolyl and indazolyl.

As used herein, the term "mesityl" refers to the substituent derived from mesitylene, or 1,3,5-trimethylbenzene.

As used herein, "diisopropylphenyl" is the substituent

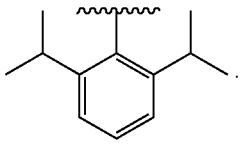

As used herein, "MIC" refers to meso-ionic carbene.

As used herein, the term "resin" or "ion exchange resin" refers to a polymer(s) that is capable of exchanging particular ions within the polymer with ions in a solution that is passed through them.

As used herein, a "chemically derivatizable group" is any functional group capable of participating in a chemical reaction, such as, but not limited to, electrophilic/nucleophilic substitution, addition, elimination, acid/base, reduction, oxidation, radical, pericyclic, Diels-Alder, metathesis or click chemistry reactions.

As used herein, the term "chemical mechanical planarization polishing" refers to a process of smoothing surfaces with the combination of chemical and mechanical forces.

As used herein, the term "atomic layer etching" refers to a technique used in semiconductor manufacturing that alternates between a self-limiting chemical modification step, which affects only the top atomic layers, and an etching step, which removes only the chemically-modified area. This method allows for removal of individual atomic layers.

As used herein, the term "unsubstituted" refers to any open valence of an atom being occupied by hydrogen. Also, if an occupant of an open valence position on an atom is not specified then it is hydrogen.

As used herein, "NHC" or "carbene" refers to an N-heterocyclic carbene. Structural formulae of certain NHCs and NHCs on metal surfaces are presented herein. As used herein, carbene is an electronically neutral species comprising a carbon having two nonbonding electrons (i.e., form a lone pair), which is referred to as the "carbene carbon." In the carbenes used in the method and materials of the present application, this carbon having the two nonbonding electrons is the carbon that will be bound to a metal surface and is divalent; in other words, this carbon is covalently bonded to two substituents of any kind, and bears two nonbonding electrons that may be spin-paired (singlet state), such that the carbon is available for formation of a dative bond. As used herein, N-heterocyclic carbene refers to heterocyclic moiety that includes a carbene, as defined above, which is electronic and/or resonance stabilized, typically by the presence of one or more carbene-adjacent heteroatoms, and/or is sterically stabilized by substituents adjacent to the carbene. A non-limiting example of such a stabilized carbene is provided below:

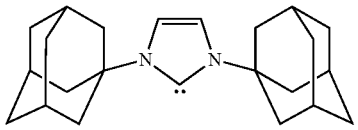

As would be well appreciated by a worker skilled in the art, there are many alternative substituents that would stabilize the carbene. Furthermore, as would be readily apparent to a worker skilled in the art, in the case of two stabilizing substituents, it is not necessary for the two substituents to be the same.

As used herein, a "carbene precursor" refers to a non-carbenic species that, under appropriate conditions, will generate a carbene in situ, such as an N-heterocyclic carbene, as defined above, either directly, or indirectly through a transient or intermediate species.

As used herein, a "self-assembled monolayer" is a molecular assembly formed spontaneously, from, for example, the vapour or liquid phase, onto surfaces by adsorption or chemisorption, and are organized into large, essentially ordered domains.

As used herein, the term "uniform" when used to refer to a monolayer, as defined above, indicates that the monolayer is generally consistent, or without significant variation, across substantially the entirety of the functionalized surface.

As used herein, the term "stability" refers to both the physical and chemical stability of the herein described carbene monolayers. "Physical stability" refers to retention of improved physical properties of carbene monolayers on a timescale of their expected usefulness in the presence of air, moisture or heat, and under the expected conditions of application. This physical stability is relative to other self-assembled monolayer-functionalized surfaces, such as thio-functionalized surfaces. "Chemical stability" refers to thermodynamic stability of the carbene monolayers upon exposure to different chemicals or mixtures of chemicals, including but not limited to air, oxygen, water, acid, base, oxidant, reductant, etc. It may refer to a lack of undesired chemical reactivity exhibited by the carbene monolayers in the environment, or under the conditions, of normal use. That is, it retains its useful properties on the timescale of its expected usefulness in the presence of air, moisture or heat, and under the expected conditions of application. This chemical stability may be defined relative to other self-assembled monolayer-functionalized surfaces, such as thio-functionalized surfaces.

The term "immersing" or "immersion" as used herein will be understood to mean any method of contacting a metal-containing material with carbenes, as described herein, and/or carbene precursors, as described herein, in such a manner that a metal surface of the metal-containing material is fully or partially covered by the carbenes and/or carbene precursors. Immersing can include, but is not limited to, dipping a metal material into a solution, pouring or flowing a solution over a metal surface, spraying a metal surface with a solution, or roll coating a surface.

As used herein, "microelectronic devices" refers to very small electronic designs and/or components that are made from semiconducting materials and manufactured on the micrometer scale, or smaller, Examples of such devices include, but are not limited to, transistors, capacitors, inductors, resistors, diodes, insulators, conductors or combinations thereof.

As used herein, the term "surface properties" refers to properties imparted to a surface as a result of being functionalized by heterocyclic carbenes, as described herein. Examples of said surface properties include, but are not limited to, hydrophobicity/hydrophilicity, conductivity, electrical impedance, piezoelectricity, absorbance, radiance, fluorescence, chemical or biochemical reactivity, or luminescence.

As used herein, the term "sensing applications" refers to systems, methods, procedures, and/or instruments that use sensors to receive and respond to signals and/or stimuli. Examples of sensors can include, but are not limited to, optical sensors (based on, for example, absorbance, reflectance, luminescence, fluorescence, or light scattering effects); electrochemical sensors (based on, for example, voltammetric, amperometric, and potentiometric effects, chemically sensitized field effect transistors, or potentiometric solid electrolyte gas sensors); electrical sensors (based on, for example, metal oxide semiconductors or organic semiconductors); mass-sensitive sensors (based on, for example, piezoelectric or surface acoustic wave effects); magnetic sensors (based on, for example, paramagnetic properties); thermometric sensors (based on, for example, heat effects of a specific chemical reaction, or adsorption); radiation sensitive sensors (based on, for example, absorbance or radiation emission); biosensors (based on, for example, signal transduction, biological recognition elements, or an analyte being sensed) (D. Buenger, et al., *Progress in Polymer Science* 37, 1678 (2012)). Specific sensing applications can include, but are not limited to, surface plasmon resonance.

As used herein, the term 'metallic surface' refers to a surface comprising metal, wherein the metal may be metal (s), metal alloy(s), metal oxide(s), or a combination thereof.

As used herein the abbreviation "XPS" is used to refer to X-ray photoelectron spectroscopy. A typical XPS spectrum is a plot of number of electrons detected as a function of the binding energy of detected electrons. Each element produces a characteristic set of XPS peaks at characteristic binding energy values. The peaks identify each element, and often its oxidation state, that exists on or approximately 100 nm below, a surface being analyzed. XPS reveals the number of detected electrons in each of the characteristic peaks. This number is related to the amount of an element within the sample, and it reveals whether contamination, if any, exists at the surface or in the bulk of the sample.

As used herein, the term "UHV" refers to ultra-high vacuum.

As used herein, the term "TPD" refers to temperature programmed desorption.

As used herein, the term "LEED" refers to low energy electron diffraction.

As used herein, the term "SAM" refers to self-assembled monolayer.

As used herein, the term "THF" refers to tetrahydrofuran.

As used herein, the term "NMR" refers to nuclear magnetic resonance.

As used herein, the term "QMS" refers to quadrupole mass spectrometry.

As used herein, the term "1a" refers to 1,3-Diisoproplylbenzimidazolium iodide. As used herein, the term "1b" refers to 1,3-dimethylbenzimidazolium iodide.

As used herein, the term "1 d" refers to 5-(Dodecyloxy)-1,3-diisopropyl-1H-benzo[d]imidazol-3-ium iodide.

As used herein, the term "2a" refers to 1,3-dihydro-1,3-bisisopropylbenzimidazol-2-ylidene), see structural formulae in Example 14.

As used herein, the term "3a" refers to 1,3-diisopropylbenzimidazolium hydrogen carbonate, see structural formulae in Example 14.

As used herein, the term "3b" refers to 1,3-dimethylbenzimidazolium hydrogen carbonate).

As used herein, the term "3 d" refers to 5-(Dodecyloxy)-1,3-diisopropyl-1H-benzo[d]imidazol-3-ium hydrogen carbonate.

As used herein, the term "dibenzylNHC" refers to 1,3-dibenzyl-1H-benzo[d]imidazol-3-ium hydrogen carbonate.

DESCRIPTION

Embodiments of the present application provide a method of etching a metallic surface for use, for example, in microelectronics applications. Etchants (i.e., etching solids or etching solutions) have been prepared and tested that include an N-heterocyclic carbene moiety. Results showed that such etchants etched metal oxides and metal from a metal substrate or metallic surface. Such etchants may have applications in industries such as sensing, electrochemistry, drug delivery, surface protection, microelectronics and microelectromechanical systems, among others.

An step in the microelectronics manufacturing process is the removal of surface residues. Compounds that are effective in etching oxide residues from a metal substrate are needed. Copper is a metal of choice, replacing aluminum in integrated circuit interconnections, due to copper's characteristics, such as low resistivity and high immunity to electro-migration, which may result in greater circuit reliability. An industry move toward copper has created a need for a composition that is specifically formulated to remove residues from a metal substrate or metallic surface, e.g., copper, without unnecessarily damaging the substrate/surface or its neighboring materials. Etching solution described herein would be useful as a chemical part of a chemical mechanical planarization polishing method and may be useful for atomic layer etching.

Embodiments of etchants include carbene salts having a general structural formulae (II), (IIa), (III), (IIIa), (IV), (Iva) or (VI) as shown below, and wherein the terms are as defined below:

(II)

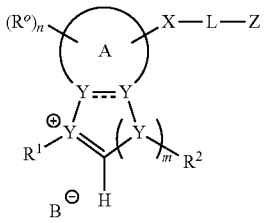

(IIa)

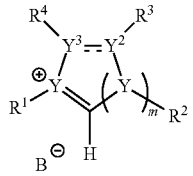

-continued (III)

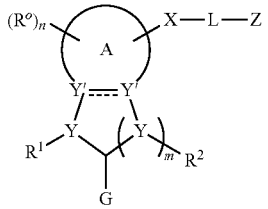

(IIIa)

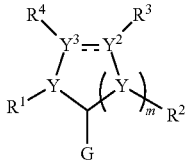

(IV)

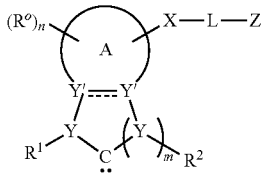

(IVa)

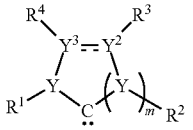

(VI)

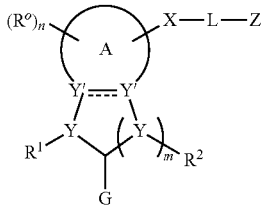

where n is an integer from 1 to 8, or from 1 to 4;

m is an integer from 0 to 4;

B is a counter ion that optionally acts as a base;

G is a perhalogenated alkyl, perhalogenated alkenyl, perhalogenated alkynyl, a perhalogenated aryl, or OR', wherein R' is an aliphatic group, for example, an alkyl group;

Y, Y', $Y^2$ and $Y^3$ are independently C or a heteroatom, and the dashed line is an optional double bond;

each $R^o$ is independently H, halogen, the substituent X-L-Z as defined above, $C_1$-$C_{10}$ alkyl, $C_{10}$-$C_{20}$ alkyl, $C_1$-$C_{10}$ alkenyl, $C_{10}$-$C_{20}$ alkenyl, $C_1$-$C_{10}$ alkynyl, $C_{10}$-$C_{20}$ alkynyl, $C_1$-$C_{10}$ alkoxyl, $C_{10}$-$C_{20}$ alkoxyl, $C_3$-$C_{20}$ cyclic aliphatic moiety, aryl, heteroaryl, ether, thioether, amine, polyamine, polyether, or polythioether, each of which is optionally substituted; or, two of $R^o$, together with the atoms to which they are attached, are connected to form a cycle, heterocycle, or an N-heterocyclic carbene precursor, each of which is optionally substituted;

$R^1$ and $R^2$ are independently absent, at least one lone pair of electrons, H, $C_1$-$C_{10}$ alkyl, $C_{10}$-$C_{20}$ alkyl, branched $C_1$-$C_{10}$ alkyl, $C_{10}$-$C_{20}$ alkenyl, $C_1$-$C_{10}$ alkynyl, or $C_{10}$-$C_{20}$ alkynyl), $C_3$-$C_{20}$ cyclic aliphatic moiety, aryl, heteroaryl, ether, thiol, thioether, amine, polyamine, polyether, polythioether, or polythiol, each of which is optionally substituted; or, one of $R^1$ or $R^2$, with one of $R^o$, together with the atoms to which they are attached, are connected to form a cycle, or heterocycle, each of which is optionally substituted;

$R^3$ and $R^4$ are independently H, halogen, the substituent X-L-Z as defined for Formula II, $C_1$-$C_{10}$ alkyl, $C_{10}$-$C_{20}$ alkyl, $C_1$-$C_{10}$ alkenyl, $C_{10}$-$C_{20}$ alkenyl, $C_1$-$C_{10}$ alkynyl, $C_{10}$-$C_{20}$ alkynyl, $C_1$-$C_{10}$ alkoxyl, $C_{10}$-$C_{20}$ alkoxyl, $C_3$-$C_{20}$ cyclic aliphatic, aryl, heteroaryl, ether, thioether, amine, polyamine, polyether, or polythioether, each of which is optionally substituted; or, any one of $R^3$ or $R^4$, with any one of $R^1$ or $R^2$, together with the atoms to which they are attached, are connected to form a cycle, or heterocycle, each of which is optionally substituted;

X is C or a heteroatom;

L is a divalent moiety, such as $C_1$-$C_{10}$ alkylene, $C_{10}$-$C_{20}$ alkylene, $C_1$-$C_{10}$ alkenylene, $C_{10}$-$C_{20}$ alkenylene, $C_1$-$C_{10}$ alkynylene, $C_{10}$-$C_{20}$ alkynylene, or dextran, a simple sugar, complex sugar, carbohydrate, ether, thioether, amine, polyamine, polyether, and/or polythioether, each of which is optionally substituted; and Z is H, an aliphatic cycle, a heterocycle, an aromatic ring, a fused aromatic ring system, a heteroaromatic ring, a fused heteroaromatic ring system, an organometallic complex, a transition-metal catalyst, a metal-oxide catalyst, a simple sugar, a complex sugar, a carbohydrate, or a chemically derivatizable group, such as —OH, azide, carboxylic acid, carbonyl chloride, anhydride, ester, aldehyde, alcohol, amine, halogen, epoxide, thiirane, aziridine, amino acid, nucleic acid, alkene, alkyne, conjugated diene, thiol, or thioester, each of which is optionally substituted.

In some embodiments, $R^1$ and $R^2$ are independently methyl, ethyl, propyl, butyl, isopropyl, phenyl, mesityl, or 1,3-diisopropylphenyl, each of which may be optionally substituted.

Specific compounds that are examples of etchants that fall under the above general formulae are shown in Table 4.

Certain carbene salts have been prepared herein as air stable hydrogen carbonate salts that are substantially free of iodide. Details regarding this synthesis and ion exchange are provided in the working examples herein. Iodide-free carbonate salts of NHC compounds and free carbenes have been tested for etching ability on examples of metallic surfaces (e.g., copper, tungsten, etc.). Results indicated that the carbene carbonate salts and the free carbenes etched both copper oxide and copper from oxidized copper samples, and etched tungsten oxide. As indicated in FIG. 1, in some embodiments the carbonate salt of the carbene was shown to be more effective at etching than the free carbene. Accordingly, evidence of an ability to etch metal oxide and metal from an oxidized metal surface has been identified and quantified. Details of this etching are provided in the Working Examples and in the Figures and Tables.

Referring to FIGS. 1A-1E, XPS spectra are shown for six copper samples that underwent different treatment conditions. Each of FIGS. 1A-1E show traces for the six samples but focuses on the binding energy of a particular element. Specifically, FIG. 1A shows Cu(2p), FIG. 1B shows Cu(Auger), FIG. 1C shows O(1s), FIG. 1D shows C(1s), and FIG. 1E shows N(1s). In each case the traces are as follows: traces labelled as (1) are for oxidized Cu with no NHC treatment, traces labelled (2) are for oxide-free Cu with no NHC treatment, traces labelled (3) are for oxide-free Cu after treatment with NHC (2a), traces labelled (4) are for oxidized Cu after treatment with NHC (2a), traces labelled (5) are for oxide-free Cu after treatment with NHC salt (3a), and traces labelled (6) are for oxidized Cu after treatment with NHC salt (3a). Results are tabulated in Tables 1 and 2.

Referring to FIG. 1A, notably, trace (1) shows strong shake-up satellites, which indicate the presence of a Cu(+2) species, e.g., CuO. This evidence of the presence of copper oxide is further supported by the presence of a single peak observed in the Cu(Auger) peak at 917.7 eV (see FIG. 1*b*, trace 1) and by the presence of a peak in the O(1s) spectrum (see FIG. 1*c*, trace 1) at 529.2 eV. C(1s) and N(1s) signals were also present, as shown in traces labelled (1) in FIGS. 1D and 1E, respectively.

Traces labelled (2) in FIGS. 1A-E are of an oxide-free copper substrate. Notably, no shake-up peaks were observed in the Cu(2p) region for this sample (see FIG. 1A, trace 2). The Auger spectrum shows a sharp peak at 918.8 eV (see FIG. 1B, trace 2), which is consistent with metallic Cu. A low intensity signal of C(1s) (see FIG. 1D, trace 2) and O(1s) (see FIG. 1C, trace 2) were recorded, while no N(1s) signal was observed (see FIG. 1E). These results are evidence that the cleaning procedure outlined in Example 2A is effective at eliminating copper oxide.

Spectra of a free NHC molecule adsorbed on oxide-free Cu (traces labelled (3)) and oxidized Cu substrates (traces labelled (4)) are shown in FIGS. 1A-E, respectively. No change was observed for the Cu (2p) position (FIG. 1A, trace 3) compared to oxide-free Cu (FIG. 1A, trace 2). A shift to a lower binding energy of approximately 1 eV was observed in case of trace (4) compared to the oxidized Cu (trace 1). The Auger spectra seen in traces 3 and 4 indicate the presence of two Cu species. These two Cu species are copper in its metallic state, and a Cu (+1) species. There is no indication of a Cu (+2) species present on either sample. The intensity of the Cu (+1) species for trace 4 was higher than the intensity of the Cu (+1) species for trace 3. The C(1s) and N(1s) spectra were also identical for traces 3 and 4 (see Table 1). The C:N peak area ratio when free NHC was adsorbed on oxide-free copper (14:2, see Table 2) was similar to the stoichiometric ratio of the carbene species, which is 13:2. When adsorbed on an oxidized copper, a higher C:N ratio was observed. The O(1s) intensity was somewhat higher on an oxidized sample treated with free NHC (trace 3) than on the non-oxidized case intensity in trace (4), but both were much lower than on an untreated copper oxide sample (trace (1)). Furthermore, both showed the presence of two new oxygen peaks at 530.2 and 532 eV. These results indicated that free NHC completely removed any Cu(+2) oxides on the substrate's surface, and significantly reduced the amount of other oxides that were present. These results also indicated that an NHC over-layer containing some form of mixed carbene oxide compound was present on the substrate's surface following exposure to carbene species.

Spectra of the $HCO_3$—NHC molecule adsorbed on oxide-free Cu and oxidized Cu surfaces are shown in traces (5) and (6) of FIGS. 1A-E, respectively. The Cu(2p) peak was observed at 932.6 eV for both samples. The Auger spectra at 918.8 eV for both samples was consistent with metallic Cu and it was substantially identical for traces (5) and (6). O(1s), C(1s), and N(1s) peaks were found to be similar in both samples (Table 1). Again, two oxygen species are present, although in different intensity ratios as in the case of the free carbene, and the C:N area ratio is similar for both samples and approximately consistent with the stoichiometry of the carbene species (13:2). These results support the removal of the copper oxide layer from the oxidized copper substrate. Importantly, this study illustrated the ability of $HCO_3$—NHC to remove C- and N-contamination thereby etching copper oxide to leave a clean Cu surface. In some embodiments, a carbene oxide compound could then be adsorbed onto the clean surface. In other embodiments, a carbene monolayer could self-assemble on the clean surface. The presence of both the C(1s) and N(1 s) XPS signals in the intensity ratio consistent with that of a carbene species indicated the presence of an intact carbene monolayer. The presence of an O(1s) XPS signal at 534.6 eV, associated only with the presence of carbene, and not known to be associated with oxygen-containing Cu compounds, indicated the presence of a carbene oxide compound.

In order to further investigate the ability of NHC to etch an oxide layer from a Cu surface, substrates were immersed into solutions that were subjected to mass spectrometric (MS) analysis. An NHC (2a) solution and an NHC (3a) solution were used to etch the oxide layer. Through MS analysis, a number of copper/NHC and NHC/oxygen complexes were identified. Two major species that were observed from the study of (3a) are reported in Table 3A. These results provided clear evidence of Cu and O in the etching solutions. An ion observed at 218.15 amu was assigned to an oxygen-substituted carbene species, demonstrating the oxide component of the copper oxide layer is removed from the surface as this species. An ion observed at 467.27 amu was assigned to a solution phase carbene complex of copper, demonstrating a mechanism of copper etching from the surface.

Figure 2:
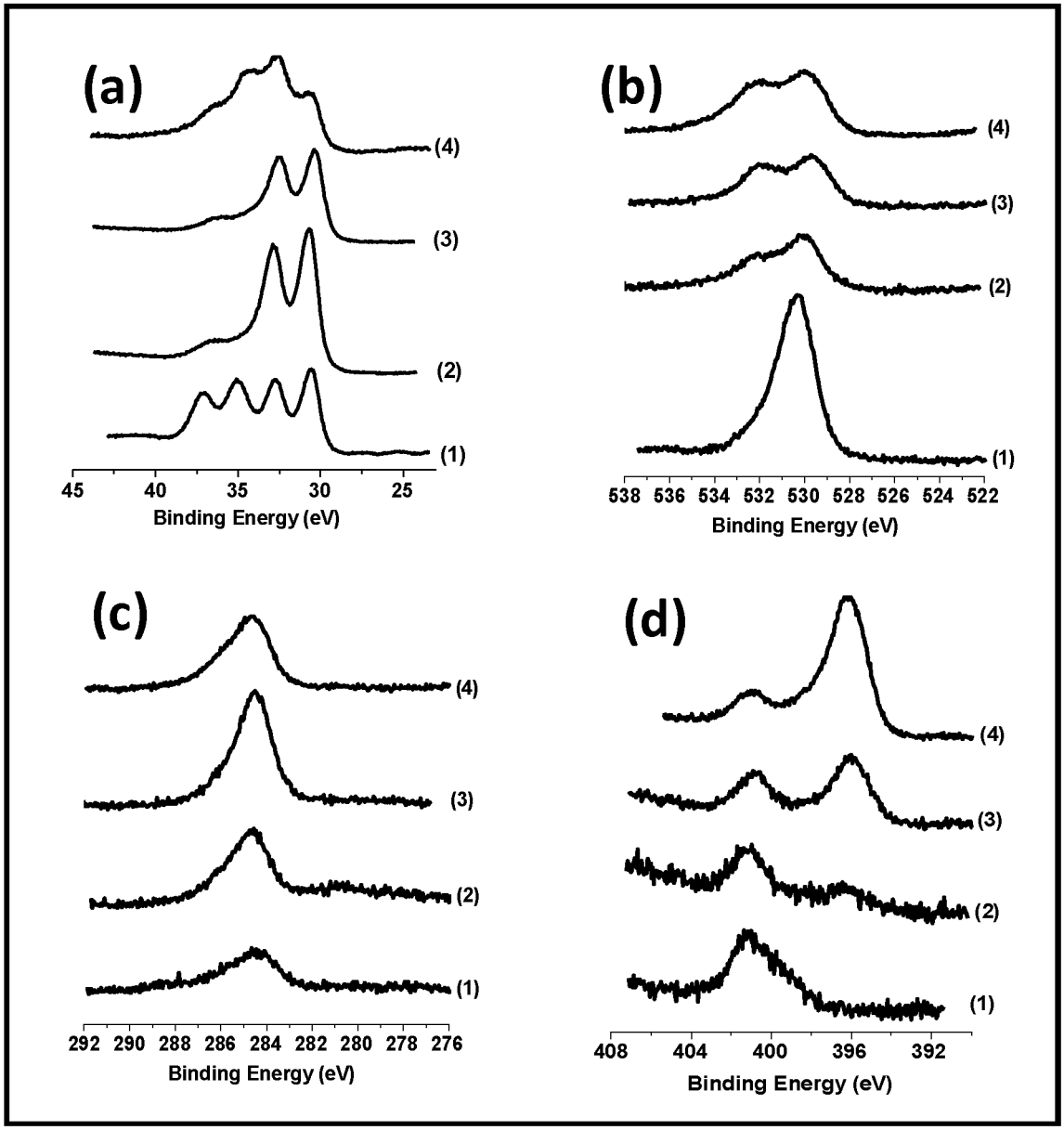
FIG. 2A shows a XPS spectra of W(4f), plotting binding energy vs. relative intensity, where trace 1 is oxidized W with no NHC treatment; trace 2 is oxidized W immersed in a (3a) solution for 24 h; trace 3 is oxidized W immersed in a (3a) solution for 48 h, and trace 4 is oxidized W immersed in a (3a) solution for 54 h.
FIG. 2B shows a XPS spectra of O(1s), plotting binding energy vs. relative intensity, where trace 1 is oxidized W with no NHC treatment; trace 2 is oxidized W immersed in a (3a) solution for 24 h; trace 3 is oxidized W immersed in a (3a) solution for 48 h, and trace 4 is oxidized W immersed in a (3a) solution for 54 h.
FIG. 2C shows a XPS spectra of C(1s), plotting binding energy vs. relative intensity, where trace 1 is oxidized W with no NHC treatment; trace 2 is oxidized W immersed in a (3a) solution for 24 h; trace 3 is oxidized W immersed in a (3a) solution for 48 h, and trace 4 is oxidized W immersed in a (3a) solution for 54 h.
FIG. 2D shows a XPS spectra of N(1s), plotting binding energy vs. relative intensity, where trace 1 is oxidized W with no NHC treatment; trace 2 is oxidized W immersed in a (3a) solution for 24 h; trace 3 is oxidized W immersed in a (3a) solution for 48 h, and trace 4 is oxidized W immersed in a (3a) solution for 54 h.

Referring to FIGS. 2A-D, XPS analysis is shown for W samples having undergone various treatment conditions. The W(4f) spectra for the oxidized tungsten substrate (see trace (1) of FIG. 2A) exhibits four characteristic peaks at 30.6, 32.7, 35.0, and 37.1 eV, of which the first two peaks represent metallic W and the latter two peaks at higher binding energies corresponding $W^{+6}$ bound to oxygen. Notably, a high intensity O(1s) peak was observed as shown in FIG. 2B. C(1s) and N(1s) signals were also present, as shown in FIGS. 2C and 2D. Traces (2), (3) and (4) are for the oxidized W immersed in $HCO_3^-$—NHC solution for 24, 48 h and 54 h respectively. The W(4f) spectra for traces (2) and (3) showed only two major peaks, which are associated with metallic W, demonstrating that exposure to the NHC solution removes the metal oxide from the surface. The O (1s) spectra as shown in FIG. 2B are consistent with this, showing an overall decrease of O signal. Two O species are present. The one at higher binding energy is consistent with an oxygen-carbene complex at the surface, and the one at lower binding energy with a metal hydroxide species present in the bulk metal. The W(4f) spectra at 54 h exposure time shows a more complex peak structure, which represents a superposition of XPS signal from at least two W species: one consistent with metallic W, and the other with a low oxidation state W species. The O (1s) species remained relatively unchanged in this case. The N (1s) spectra exhibited three peaks. Those at approximately 399 and 401 eV are associated with residual tungsten nitride species on the W sample. The one at 396 eV appears only following deposition of carbene, and its relative intensity increases with increasing exposure time to carbene. A N (1s) peak in this energy region has not been previously observed, accordingly, it was assigned to a decomposition product of the carbene complex that is bound to W. A low intensity of C was recorded for trace (1), due to residual carbon contamination of the surface. An increase in the intensity for trace (2), (3) and (4) was observed, consistent with increasing carbene deposition on the surface.

Figure 3:
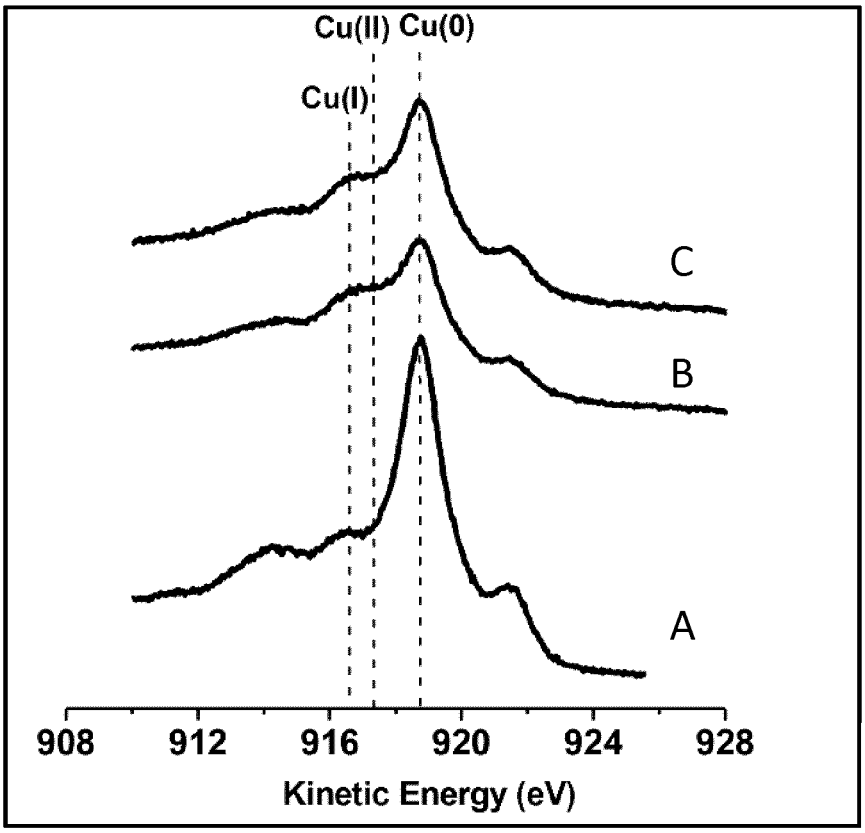

As shown in FIG. 3, the surface of the clean Cu foil is predominantly a metallic Cu(0) species. The slight shoulder to lower kinetic energy indicates trace amounts of a copper (I) species was present. Upon exposure to either 2a or 3a, the relative intensity of the Cu Auger peak was reduced. Although not wishing to be bound by theory, it is suggested that this evidence indicates binding of carbene to the surface layer, resulting in attenuation of the Cu Auger photoelectrons.

Figure 4:
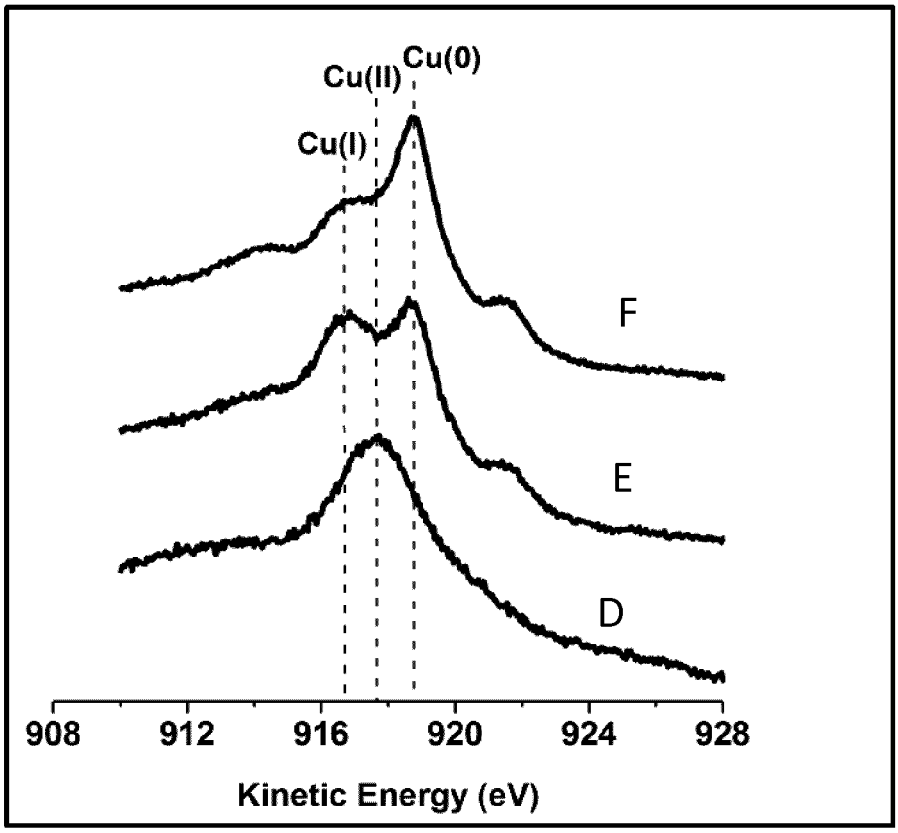

As shown in FIG. 4, evidence of etching is provided in the form of a Cu Auger LMM Spectra as a function of photoelectron kinetic energy. Specifically, a reduction in intensity of the Auger lines is visible, corresponding to Cu(I) and Cu(II) species, and an increase in intensity of the metallic Cu(0) peak is also visible, which indicate etching of the Cu layer has occurred. In addition, mass spectrometric analysis of supernatant solution showed the presence of both

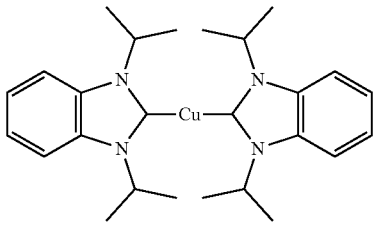

and

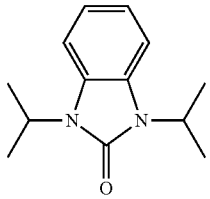

compounds. Although not wishing to be bound by theory, it is suggested that this evidence indicates that a mechanism of etching is through formation of both a copper/carbene complex and oxide byproduct of the original carbene etchant.

In order to further investigate the ability of an NHC, specifically (3a), to etch the oxide layer from the W surface, the solutions into which the substrates were immersed were subject to mass spectrometric analysis. A NHC/oxygen complex was identified (Table 3B), which is similar to the copper case, and indicates that oxygen may be removed from the surface through a mechanism of formation and subsequent desorption of an oxidized carbene species. Unlike Cu, no signals that could be associated with W could be observed in the mass spectrograph. This suggests that etching of the oxide layer follows a different mechanism on W than on Cu, in which the W oxide is reduced to metallic W, followed by desorption of an oxidized carbene species.

As shown in FIGS. 5*a*-7*g* and described in Example 4, vapour phase etching of the described NHCs has been studied.

Referring to FIG. 5*c*, a low energy electron diffraction pattern is shown of the Cu(111) surface after creation of the surface oxide. The multiple diffraction spots observed is evidence for a successful formation of domains of oxide of at least 10 nm in diameter.

Referring to FIG. 5*d*, a low energy electron diffraction pattern is shown of the same surface (and at the same beam energy, 38.3 eV) after exposure to 160 L dibenzyl NHC at 300 K. The disappearance of most of the diffraction spots compared to FIG. 1*c* is consistent with the loss of large domains of oxide.

Referring to FIG. 6*b*, a low energy electron diffraction pattern is shown of the Cu(111) surface after creation of the surface oxide. The multiple diffraction spots observed provided evidence for the successful formation of domains of oxide of at least 10 nm in diameter.

Referring to FIG. 6*c*, a low energy electron diffraction pattern is shown of the same surface (and at the same beam energy, 37.1 eV) after exposure to 13 L diisopropyl NHC at 300 K. The disappearance of most of the diffraction spots compared to FIG. 6*b* is consistent with the loss of large domains of oxide.

Referring to FIG. 7*g*, an STM image is shown of an oxidized Cu(111) surface after exposure to dimethyl NHC (3b), where residual oxidized regions appear as dark areas and large brighter metallic regions are formed close to step edges on the upper terraces. Formation of the brighter regions is considered as being due to the reduction of the surface oxide by vapour deposited 3b.

In summary regarding the vapour phase etching studies, there is evidence of a surface reaction between oxygen from surface copper oxide and various NHC molecules resulting in the desorption of CO and $CO_2$ after annealing the surface in a Temperature Programmed Desorption (TPD) experiment. The oxide surface as imaged by STM was destroyed by the adsorption of the dimethyl NHC at 300 K. An LEED experiment revealed a loss of the diffraction pattern associated with the oxide upon exposure to such NHCs and this result was supported by HREELS which showed a decrease in intensity of the Cu—O vibration. Exposure of a Cu(111) surface to a saturated monolayer of dibenzyl or diisopropyl NHC resulted in the surface becoming protected or passivated with respect to subsequent oxidation by $O_2$. Details are provided in Example 4 and in the Figures.

The following working examples further illustrate the present invention and are not intended to be limiting in any respect.

WORKING EXAMPLES

Instrumentation:

XPS measurements were performed using a Thermo Microlab 310F ultrahigh vacuum (UHV) surface analysis instrument (available from Thermo Fisher Scientific, Waltham, MA, USA). Mass spectrometry measurements were performed using Thermo scientific LTQ orbitrap velos pro mass spectrometer (available from Thermo Fisher Scientific, Waltham, MA, USA). $^1$H and $^{13}$C NMR, spectra were recorded on Bruker Avance-400, 500 or 600 MHz spectrometers (Bruker, Coventry, UK). Chemical shifts are reported in delta (δ) units, expressed in parts per million (ppm) downfield from tetramethylsilane, using residual protonated solvent as an internal standard ($^1$H NMR $CDCl_3$: 7.26, methanol-$d_4$: 3.31 ppm; $^{13}$C NMR $CDCl_3$: 77.16, methanol-$d_4$: 49.00 ppm). All 2D spectra (gs-COSY, gs-HSQC, gs-HMBC) were acquired in the phase-sensitive mode. All data were acquired, processed, and displayed using BrukerXWinNMR and MestReNova software and a standard pulse-sequence library. All measurements were carried out at 298 K. IR spectra were collected on a Bruker ALPHA Platinum ATR as neat solids and absorption bands are given in $cm^{-1}$. Melting points were recorded on an Electrothermal MEL-TEMP apparatus connected to a Fluke 51 II Thermometer. Temperatures are given in degree Celsius (° C.) and are uncorrected. Elemental analyses were performed using Flash 2000 CHNS—O analyzer or Carlo Erba EA 1108 CHNOS Elemental Analyzer.

Materials

Solvents were used without purification except where stated. THF was distilled from sodium, and DriSolv methanol was purchased from Fisher Scientific and used as received. All other reagents were purchased from chemical suppliers (e.g., Aldrich) and used as received. Reactions requiring an inert atmosphere were carried out in a nitrogen-filled glovebox (M. Braun) with oxygen and water levels ≤2 ppm.

Example 1. Preparation of NHC Compounds

Example 1(i). Preparation of 1,3-Diisoproplylbenzimidazolium iodide ("1a") and 1,3-dimethylbenzimidazolium Iodide ("1b")

1,3-Diisoproplylbenzimidazolium iodide, 1a, and 1,3-dimethylbenzimidazolium iodide, 1b, were prepared according to literature procedures (Chen, W. C. et al., (2014) *Chemistry—a European Journal* 20, 8099-8105).

Example 1(ii). Synthesis of 1,3-Dihydro-1,3-bisisopropyl-2H-benzimidazol-2-ylidene, ("2a")

1,3-Diisopropyl-1H-benzo[d]imidazole-3-ium iodide (317 mg, 0.908 mmol) (see Huynh, H. V., et al. *Organometallics* 25, 3267-3274 (2006)) was dissolved in 10 mL of anhydrous THF in a glove box. A solution of KOtBu (108 mg, 0.908 mmol) in THF (20 mL) was added dropwise over an hour. The reaction was stirred for an additional hour. The THF was then evaporated under vacuum, and the resulting residue was dissolved in toluene and filtered through Celite®. Evaporation of the filtrate gave the desired free carbene as a yellow oil in 68% yield. $^1$H NMR ($C_6D_6$) δ (ppm): 7.3-7.2 (br, 4H, PhH), 4.52 (sept, $J_{HH}$=6.6 Hz, 2H, CH—$(CH_3)_3$), 1.63 (d, $J_{HH}$=6.65 Hz, 12H, $CH_3$).

Example 1(iii). Preparation of 1,3-Diisopropylbenzimidazolium hydrogen carbonate, ("3a")

1,3-Diisopropylbenzimidazolium hydrogen carbonate, (3a), was prepared using a hydrogen peroxide oxidation in presence of carbon dioxide. Specifically, a 50 mL round bottom flask capped with a rubber septum and containing a needle for ventilation and a glass pipette for addition of gaseous carbon dioxide was charged with a clear colorless solution of 1,3-diisoproplylbenzimidazolium iodide (1a) (990.6 mg, 3 mmol) in deionized water (30 mL) (pH=6). $CO_2$ was bubbled through this solution for 1 min, after which time hydrogen peroxide (193 μL (30% w/v), 2.25 mmol in 0.5 mL water) was injected. Vigorous $CO_2$ bubbling was maintained for 1 h under stirring during which time the solution turned yellow and then brown until the formation of a purple precipitate was detected. The mixture was filtered by vacuum filtration and washed with 3 mL of water resulting in a clear colorless filtrate solution (pH=8), leaving the insoluble iodine as a violet solid precipitate. Water was removed by flushing air overnight over the surface of the solution then the product was dried under high vacuum for 2 h to give a white solid. The resulting solid was triturated and sonicated in acetone (3×3 mL), which was then decanted off. Subsequent drying under vacuum afforded the desired product as a white powder (478 mg, 66% yield).

To test for complete removal of iodine, a qualitative silver nitrate test was performed where one drop from the reaction aliquot was mixed with excess aqueous silver nitrate (1 M) solution. In cases where incomplete exchange was observed, a yellow precipitate of silver iodide formed that persisted upon the addition of nitric acid. When iodide was completely exchanged, a white precipitate of silver bicarbonate formed that became colorless upon addition of a solution of 1M nitric acid. Quantitatively, the removal of iodide was assessed by elemental analysis in house looking at CHN and also externally analyzing for iodide content. Mp: 123-124° C. (dec.). $^1$H NMR (400 MHz, $CD_3OD$): δ 8.07 (dd, J=6.3, 3.2 Hz, 2H, Ar—H), 7.75 (dd, J=6.3, 3.1 Hz, 2H, Ar—H), 5.11 (hept, J=6.7 Hz, 2H, NCHiPr), 1.77 (d, J=6.7 Hz, 12H, $CH_3$iPr). The $N_2CH$ and $HCO_3$ protons could not be observed due to their rapid exchange with the deuterated solvent on the NMR time scale. $^{13}$C ($^1$H) NMR (100 MHz, $CD_3OD$): 161.42 (s, $HCO_3$), 138.96 (s, $N_2CH$), 132.59 (s, $C_q$), 128.19 (s, $C_{Ar}$), 114.97 (s, $C_{Ar}$), 52.83 (s, CHiPr), δ 22.11 (s, $CH_3$iPr). ATR-IR: strong peaks for $CO_2$ asym. str. at 1622 cm$^{-1}$ and sym. str. at 1367 cm$^{-1}$. Anal. Calc. for $C_{14}H_{20}N_2O_3$: C, 63.62; H, 7.63; N, 10.60. Found: C, 63.63; H, 7.83; N, 10.38, I<0.2. HRESI-MS (m/z) for $C_{13}H_{19}N_2^+$ $[M-HCO_3]^+$: 203.1543, Calc.: 203.1543.

Hydrogen Carbonate-Anion Exchange Resin

Firstly, a hydrogen carbonate exchange resin was prepared from commercial (Sigma Aldrich) Amberlyst A26 hydroxide resin. To accomplish the conversion, 10 g (0.8 meq/mL) of the resin was suspended in 10 mL deionized water (pH=8) and carbon dioxide bubbled through the solution for 0.5 h (pH=6, as measured by a pH strip). To test the conversion of the resin, aqueous KI (0.2 mL, 0.4 M) was added to 0.2 mL of resin before and after $CO_2$ bubbling. The mixtures were sonicated for 10 min and to one drop of the aliquots, excess aqueous silver nitrate (1 M) was added. The fresh (hydroxide) resin gave a dark brown precipitate of silver oxide, while the bicarbonate resin gave a white precipitate of silver bicarbonate. Both precipitates gave a clear colourless solution after addition of nitric acid. After this, the resin was used to treat several iodide salts as described below.

Resin-$HCO_3$ suspended in water was measured out in a graduated cylinder (3.8 mL, 3 equiv., prepared as described above) and transferred to a 20 mL vial where the resin was allowed to settle and water was decanted. The resin was washed with methanol (3×2 mL). 1,3-Diisoproplylbenzimidazolium iodide (1a) (320 mg, 1 mmol) (10) was dissolved in 5 mL methanol and transferred to the resin. The mixture was stirred for 30 min. The silver nitrate test indicated the completeness of the exchange reaction. The hydrogen carbonate solution was passed through a cotton plug to remove any resin beads and the resin was washed with methanol (3×2 mL), which was then added to the original filtrate. Solvent was evaporated and the residual solid was triturated and sonicated in acetone (3×3 mL), which was then decanted off via syringe and discarded. Subsequent drying of the white powder under vacuum afforded the desired product as a white powder (198 mg, 75% yield). Mp: 123-125° C. (dec.). Anal. Calc. for $C_{14}H_{20}N_2O_3$: C, 63.62; H, 7.63; N, 10.60. Found: C, 63.34; H, 7.70; N, 10.71

Example 1(iv). Preparation of 1,3-Dimethylbenzimidazolium hydrogen carbonate, [$Me_2$bimy(H)] [$HCO_3$] ("3b")

Hydrogen Peroxide Oxidation in Presence of Carbon Dioxide:

A 50 mL round bottom flask that was capped with a rubber septum and containing a needle for ventilation and a glass pipette for addition of gaseous carbon dioxide, was charged with a clear colorless solution of 1,3-diimethyllbenzimidazolium iodide (1b) (274.1 mg, 1 mmol) in deionized water (7 mL) (pH=6). Carbon dioxide was bubbled for 1 min followed by addition of hydrogen peroxide (65 μL (30% w/v), 0.75 mmol in 0.5 mL water, 1.5 equiv). Vigorous $CO_2$ bubbling was maintained for 1 h under stirring during which time the solution turned yellow and then brown until the formation of a purple precipitate was detected. The mixture was filtered and washed with water (3×2 mL) resulting in a clear colorless filtrate solution (pH=8). Water was removed by flushing air overnight over the surface of the solution then it was dried under high vacuum for 2 h to give a white solid. The residual solid was triturated and sonicated in acetone (3×2 mL), which was then decanted off. Subsequent drying under vacuum afforded the desired product as a white powder (123 mg, 59% yield) Mp: 137-138° C. (dec.). $^1$H NMR (400 MHz, $CD_3OD$): δ 7.96 (dd, J=6.2, 3.1 Hz, 2H, Ar—H), 7.74 (dd, J=6.3, 3.1 Hz, 2H, Ar—H), 4.15 (s, 6H, $CH_3$). The $N_2CH$ and $HCO_3$ protons could not be observed due to their rapid exchange with the deuterated solvent on the NMR time scale. $^{13}$C ($^1$H) NMR (100 MHz, $CD_3OD$): δ 161.38 (s, $HCO_3^-$), 143.94 (s, $N_2CH$), 133.54 (s, $C_q$), 128.18 (s, $C_{Ar}$), 114.15 (s, $C_{Ar}$), 33.65 (s, $CH_3$). ATR-IR: strong peaks for $CO_2$ asym. str. at 1626 cm$^{-1}$ and sym. str. at 1367 cm$^{-1}$. Anal. Calc. for $C_{10}H_{12}N_2O_3$: C, 57.68; H, 5.81; N, 13.45. Found: C, 57.72; H, 5.75; N, 13.03. HRESI-MS (m/z) for $C_9H_{11}N_2^+[M-HCO_3]^+$: 147.0913, Calc.: 147.0917.

Hydrogen Carbonate-Anion Exchange Resin:

Resin-$HCO_3$ (5.7 mL, 3 equiv.) suspended in water was measured in a graduated cylinder. The resin was transferred to 50 mL round bottom flask and water was removed by decantation. The resin was washed with methanol (3×4 mL). 1,3-Diimethyllbenzimidazolium iodide (1b) (411 mg, 1.5 mmol) was dissolved in 7.5 mL methanol and transferred to the resin. The mixture was stirred for 30 min. The silver nitrate test indicated the completeness of the exchange reaction. The bicarbonate solution was passed through a cotton plug to remove any resin beads and the resin was washed with methanol (3×2 mL). Solvent was evaporated using rotavap at 40° C. then in vacuo. The residual solid was triturated and sonicated in acetone (3×3 mL), which was then decanted off. Subsequent drying under vacuum afforded the desired product as a white powder (233 mg, 75% yield). Mp. 135-138° C. (dec.). Anal. Calc. for $C_{10}H_{12}N_2O_3$: C, 57.68; H, 5.81; N, 13.45. Found: C, 57.69; H, 5.77; N, 13.10.

Example 1(v). Preparation of 5-(Dodecyloxy)-1,3-diisopropyl-1H-benzo[d]imidazol-3-ium iodide ("1 d")

5-(Dodecyloxy)-1,3-diisopropyl-1H-benzo[d]imidazol-3-ium iodide (1 d) was prepared using a similar method as described in the literature procedures [C. M. Crudden et al., Nature Chem. 6, 409-414 (2014)] with a slight modification where 2-iodopropane (1.6 mL, 16 mmol, 5 equiv.) was slowly added to a suspension of 5-(dodecyloxy)-1H-benzo[d]imidazole (971 mg, 3.2 mmol) and $Cs_2CO_3$ (1.04 g, 3.2 mmol) in acetonitrile (16 mL). The mixture was heated to 90° C. in a two-necked round bottom flask under an argon atmosphere for 48 h. The reaction mixture was allowed to cool to room temperature. Water (20 mL) was added to the reaction mixture. The reaction mixture was then extracted with dichloromethane (3×30 mL). The combined organic layers were dried over anhydrous magnesium sulfate, filtered and then concentrated in vacuo. The crude solid was triturated and sonicated in diethyl ether (3×6 mL). Subsequent drying under high vacuum afforded the desired product as an off-white powder (1.30 g, 78% yield).

$^1$H NMR (400 MHz, $CDCl_3$) δ 10.81 (s, 1H, N—CH═N), 7.64 (d, 1H, $J_{HH}$=9.2 Hz, ArH), 7.21 (dd, 1H, $J_{HH}$=9.2, 2.0 Hz, ArH), 7.09 (d, 1H, $J_{HH}$=1.9 Hz, ArH), 5.10 (m, 2H, CH—$(CH_3)_3$), 4.05 (t, 2H, $J_{HH}$=6.4 Hz, O—$CH_2$), 1.84 (m, 14H), 1.48 (m, 2H), 1.26 (m, 16H), 0.87 (t, 3H, $J_{HH}$=6.6 Hz).

Example 1(vi). Preparation of 5-(Dodecyloxy)-1,3-diisopropyl-1H-benzo[d]imidazol-3-ium hydrogen carbonate (3 d)

Hydrogen Carbonate-Anion Exchange Resin

Resin-$HCO_3$ (9.4 mL, 10 equiv.) suspended in water was measured in a graduated cylinder and then transferred to 50 mL round bottom flask, allowed to settle and water was decanted. 5-(Dodecyloxy)-1,3-diisopropyl-1H-benzo[d]imidazol-3-ium iodide (358.5 mg, 0.75 mmol) was dissolved in 7.5 mL acetonitrile and transferred to the resin suspension. Water, (7.5 mL) was added to the resin. The mixture was stirred for 30 min. The bicarbonate solution was passed through a cotton plug to remove any resin beads and the resin was washed with (3×2 mL 1:1 water:acetonitrile). Solvents were removed overnight under a stream of air. The resulting yellow oily solid was triturated and sonicated in 10% acetone/diethyl ether (3×4 mL), which was then decanted off. Subsequent drying under vacuum afforded the desired product as an off-white powder (206 mg, 61% yield). Mp. 68-71° C. (dec.).

$^1$H NMR (400 MHz, $CD_3OD$): δ 7.89 (d, J=9.2 Hz, 1H, $CH_{Ar}$), 7.44 (d, J=2.1 Hz, 1H, $CH_{Ar}$), 7.30 (dd, J=9.2, 2.2 Hz, 1H, $CH_{Ar}$), 5.10-4.92 (m, 2H, CH—$(CH_3)_2$), 4.13 (t, J=6.4 Hz, 2H, —O—$CH_2$), 1.85 (m, 2H), 1.71 (dd, J=6.7, 2.5 Hz, 12H, CH—$(CH_3)_2$), 1.53 (s, 2H), 1.29 (s, 16H), 0.90 (t, $J_{HH}$=6.8 Hz, 3H, $CH_3$). The $N_2CH$ and $HCO_3$ protons could not be observed due to their rapid exchange with the deuterated solvent on the NMR time scale.

$^{13}$C ($^1$H) NMR ($CD_3OD$): δ161.43 (s, $HCO_3$), 160.43 ($C_q$—O—$CH_2$), 137.96 ($C_{Ar}$, $N_2CH$), 133.83 ($C_q$), 126.54 ($C_q$), 118.71 ($C_{Ar}$), 115.62 ($C_{Ar}$), 97.41 ($C_{Ar}$), 70.23 ($CH_2$—O), 52.80 ($CH(CH_3)_2$), 52.23 ($CH(CH_3)_2$), 33.07 ($CH_2$), 30.76 ($CH_2$), 30.75 ($CH_2$), 30.70 ($CH_2$), 30.47 ($CH_2$), 30.23 ($CH_2$), 27.15 ($CH_2$), 23.73 ($CH_2$), 22.17 ($CH(CH_3)_2$), 22.11 ($CH(CH_3)_2$), 14.43 ($CH_3$)

ATR-IR: strong peaks for $CO_2$ asym. str. at 1620 cm$^1$ and sym. str. at 1371 cm$^1$. Anal. Calc. for $C_{26}H_{44}N_2O_4$: C, 69.61; H, 9.89; N, 6.24. Found: C, 69.14; H, 9.71; N, 6.24. HRESI-MS (m/z) for $C_{25}H_{43}N_2O^+[M-HCO_3]^+$: 387.3370, Calc.: 387.3370.

Example 2(i). Preparation of Metal Substrates

Two copper substrates were used to determine whether NHC— compounds as described herein can be used to etch metal oxide and/or metal surfaces. The first substrate was an oxide-free copper substrate (available from Goodfellow, Huntingdon, England, purity 99.99%, thickness 1 mm) was cleaned by immersion in glacial acetic acid (J. T. Baker Chemical Company, purity 99.7%) at 35° C. for 5 to 10 min. This substrate was then dried under a flow of nitrogen. The second substrate was an oxidized copper substrate which was prepared by immersion of an oxide-free copper sample in a hydrogen peroxide (Fisher Scientific, 31%) solution at 50° C. for 1 min.

Example 2(ii). Etching of Metal Oxide and/or Metal Surface

Carbenes were allowed to etch and/or were allowed to form a self-assembled monolayer on both oxide-free and oxidized copper substrates using the following deposition methods.

In the $HCO_3^-$ salt method, the metal substrate was immersed in a 10 mM solution of (3a) (structural formaulae shown in Table 4) dissolved in 1,2-Dichloroethane (Sigma-Aldrich, 99.8%) at room temperature for 24 h (for the oxide-free copper substrate) and 48 h (for the oxidized copper substrate) and under ambient conditions.

In the free carbene technique, the metal substrate was immersed in a 10 mM solution of (2a) dissolved in 1,2-Dichloroethane at room temperature in a glove box for 24 h (for the oxide-free copper substrate) and 48 h (for the oxidized copper substrate). Substrates were then rinsed with anhydrous 1,2-dichloroethane and dried under an argon gas stream.

Example 3. XPS Analysis of Oxidized and Non-Oxidized Metal Substrates, Before and after Etching Procedure of Example 2B Metal samples were fixed using copper tape, mounted in a XPS instrument antechamber, and subjected to high vacuum overnight before being introduced into an ultra-high vacuum analysis chamber. XPS data were acquired using a Thermo Microlab 310F ultrahigh vacuum (UHV) surface analysis X-ray photoelectron spectrometer operating at 15 kV anode potential and 20 mA emission current with a surface/detector take off angle of 75°. A Al KαX-ray source (1486.6 eV) was used in the case of Cu experiments. The copper studies were calibrated to C (1s, 284.5 eV).

A Shirley algorithm was used as the background subtraction method for all peaks. The Powell peak-fitting algorithm was used, with peak areas normalized between different elements using the relative XPS sensitivity factors of Scofield (J. H. Scofield Journal of Electron Spectroscopy and Related Phenomena 8, 129-137 (1976)). In cases where absolute peak intensities for a single element were compared between different samples, care was taken to ensure a standard sample size and orientation with respect to the X-ray source and detector within the analysis chamber.

Example 4. Etching of Copper Oxide Surface Via Vapour Deposition of N-Heterocyclic Carbenes Etchants The inventors wish to acknowledge that vapour deposition studies of provided samples were conducted in the laboratory of Chris Baddeley, EaStCHEM School of Chemistry, University of St. Andrews, St. Andrews, UK.

Vapor Deposition of N-Heterocyclic Carbenes.

Controlled deposition of 1,3-dibenzyl-1H-benzo[d]imidazol-3-ium hydrogen carbonate was achieved by mounting a differentially pumped solid doser onto a gas manifold. The doser was separated from the main ultrahigh vacuum (UHV) chamber by a gate valve. The doser consisted of a quartz capillary tube around which was wound a metal filament. The doser was loaded with the solid and a thermocouple was placed in contact with the solid. A current was passed through the external filament to warm the solid. A quadrupole mass spectrometer was used to detect the onset of vapor deposition from the solid doser thereby achieving a calibration of the required dosing temperature.

Deposition of dibenzylNHCs onto Oxidized Cu(111) in UHV 1,3-dibenzyl-1H-benzo[d]imidazol-3-ium hydrogen carbonate was deposited via vapor deposition in UHV onto oxidized Cu(111) surfaces. In every case, the oxidized surface was prepared by heating the Cu(111) sample at 675 K in an $O_2$ atmosphere ($P=1\times10^{-6}$ to $1\times10^{-5}$ mbar) for 20 minutes, followed by heating to 800 K for 10 minutes under UHV. We believe that the oxide produced is similar to that reported (Leon, C. P. et al.; (2012) *Physical Review B: Condensed Matter and Materials Physics* 85(3): 035434/1-035434/8) and corresponds to a strained $Cu_2O(111)$ lattice that coincides with the Cu(111) substrate FIGS. 5*a* and *b* show temperature programmed desorption spectra following the adsorption of dibenzyl NHC onto the oxide surface as functions of dibenzylNHC dose. When this molecule is exposed to a metallic surface, no oxygen containing desorption products were detected (including any related to the carbonate anion). Upon exposure to the oxidized surface, desorptions of mass 28 (CO) and mass 44 ($CO_2$) were detected. The presence of these desorption products is evidence of a surface reaction between dibenzylNHC and the oxide.

FIG. 5*c* shows the low energy electron diffraction (LEED) pattern associated with the oxidized Cu surface. The observation of multiple diffraction features is consistent with the presence of extensive domains of ordered oxide on the Cu(111) surface. FIG. 5*d* shows the LEED pattern following exposure of 160 L dibenzylNHC onto the oxidized surface at 300 K. Most diffraction features have disappeared. This is consistent with the loss of long range ordered oxide from the Cu surface.

Deposition of $O_2$ onto dibenzylNHC NHC/Cu(111) Surfaces in UHV

FIGS. 5*e* and 5*f* show TPD spectra following the exposure of a dibenzylNHC/Cu(111) surface to 990 L $O_2$ at 300 K as a function of dibenzylNHC coverage. Desorption of mass 28 (CO) and mass 44 ($CO_2$) is evidence that adsorbed oxygen reacts with previously adsorbed dibenzylNHC. However at the highest coverages of dibenzylNHC (180 L) no desorption of CO or $CO_2$ is observed. We conclude that the adsorption of a full monolayer of dibenzylNHC onto Cu(111) passivates the surface from subsequent oxidation by $O_2$.

Interaction of Di Isopropyl NHCs with Oxidized Cu(111) in Ultrahigh Vacuum (UHV)

FIG. 6*a* shows TPD spectra following the exposure of diisopropyl NHC/Cu(111) surfaces to 990 L $O_2$ at 300 K as a function of diisopropyl NHC coverage. Desorption of mass 44 ($CO_2$) is evidence that adsorbed oxygen reacts with previously adsorbed diisopropyl NHC. However at the highest coverages of diisopropyl NHC (≥49 L) desorption of $CO_2$ is strongly attenuated. It was concluded that the adsorption of a full monolayer of dibenzylNHC onto Cu(111) almost completely passivates the surface from subsequent oxidation by $O_2$.

FIG. 6*b* shows the low energy electron diffraction (LEED) pattern associated with the oxidized Cu surface. The observation of multiple diffraction features is consistent with the presence of extensive domains of ordered oxide on the Cu(111) surface. FIG. 6*c* shows the LEED pattern following exposure of 13 L diisopropyl NHC onto the oxidized surface at 300 K. Most diffraction features have disappeared. This is consistent with the loss of long range ordered oxide from the Cu surface upon exposure to diisopropyl NHC.

Deposition of $O_2$ onto Dimethyl NHC/Cu(111) Surfaces in UHV

FIG. 7*a* shows TPD spectra following the exposure of dimethyl NHC/Cu(111) surfaces to 990 L $O_2$ at 300 K following a saturation exposure of dimethyl NHC at 300 K. The desorption of CO (mass 18) and $CO_2$ (mass 44) indicate that the passivation effects observed for the dibenzyl and diisopropyl NHCs are not observed in the case of the dimethyl NHCs. FIG. 7*b* shows high resolution electron energy loss spectra (HREELS) following the adsorption of dimethyl NHC onto Cu(111) (bottom trace) followed by exposure to $O_2$ and subsequent annealing of the sample. The spectra acquired at 425 K and higher temperatures are consistent with the loss of dimethyl NHC from the surface as a result of the surface reaction between the dimethyl NHC and co-adsorbed oxygen.

FIG. 7*d* shows a scanning tunneling microscopy (STM) image of the Cu(111) surface that has been exposed to a high coverage of dimethyl NHC followed by 990 L O2 at 300 K. Areas of darker contrast were interpreted as characteristic of "oxidized" regions of the surface while the areas with lighter contrast were interpreted as more metallic in character. After annealing to 445 K (FIG. 7*e*), the areas of lighter contrast occupy a larger proportion of the surface. This is interpreted as being due to the oxide being reduced by the dimethyl NHC during the thermal treatment.

Deposition of 3b onto Oxidized Cu(111) in Ultrahigh Vacuum (UHV)

FIG. 7*c* shows HREEL spectra for the oxide surface on Cu(111). The Cu—O stretching vibration is observed at ~250 $cm^{-1}$. After exposure to 3b at 300 K, the intensity of the Cu—O band decreases. This is indicative of the loss of oxygen via reaction with co-adsorbed dimethyl NHC.

FIG. 7*f* shows an STM image characteristic of the oxide surface on Cu(111). After exposure to 3b, the morphology of the surface changes. Regions, which are interpreted as being metallic in character, can be observed to form—particularly located near the upper terrace at step defects. This is further evidence of the reduction of the oxide via vapour deposited NHC.

All publications, patents and patent applications mentioned herein are indicative of the level of skill of those skilled in the art to which this invention pertains and are herein incorporated by reference to the same extent as if each individual publication, patent, or patent applications was specifically and individually indicated to be incorporated by reference.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

TABLE 1A

Binding energies of Cu(2p), O(1s), C(1s), and N(1s) and kinetic energies of Auger Cu(LMM) for various Cu samples

| Sample | Cu (2p) | Auger Cu (LMM) | O (1s) | C (1s) | N (1s) |
|---|---|---|---|---|---|
| (1) oxidized Cu | 933.7 | 917.7 | 529.2<br>530.9 | 284.3<br>287.8 | 398.9 |
| (2) oxide-free Cu | 932.6 | 916.7<br>918.8 | 531.6 | 284.2 | — |
| (3) (2a) on | 932.6 | 916.9 | 530.2 | 285.1 | 400.2 |

TABLE 1A-continued

Binding energies of Cu(2p), O(1s), C(1s), and N(1s) and kinetic energies of Auger Cu(LMM) for various Cu samples

| Sample | Cu (2p) | Auger Cu (LMM) | O (1s) | C (1s) | N (1s) |
|---|---|---|---|---|---|
| oxide-free Cu | | 918.8 | 531.8 | 286.8 | |
| (4) (2a) on | 932.6 | 916.8 | 530.4 | 285.0 | 400.0 |
| oxidized Cu | | 918.8 | 532.1 | 286.3 | |
| | | | 534.6 | | |
| (5) (3a) on | 932.6 | 916.9 | 530.2 | 285.0 | 400.3 |
| oxide-free Cu | | 918.8 | 532.4 | 286.5 | |
| (6) (3a) on | 932.6 | 916.9 | 530.2 | 285.0 | 400.0 |
| oxidized Cu | | 918.8 | 532.2 | 286.3 | |

TABLE 1B

The binding energies of W(4f), O(1s), C(1s), and N(1s) for various W samples.

| Trace | W (4f) (eV) | O (1s) (eV) | C(1s) (eV) | N (1s) (eV) |
|---|---|---|---|---|
| (1) oxidized W | 30.6<br>32.7<br>35.0<br>37.1 | 530.3<br>531.7 | 284.5<br>287.9 | 399.2<br>401.1 |
| (2) oxidized W immersed in (3a) solution for 24 h | 30.7<br>32.8 | 530.0<br>531.9 | 284.5<br>285.5 | 396.3<br>401.0 |
| (3) oxidized W immersed in (3a) solution for 48 h | 30.4<br>32.5 | 529.6<br>531.8 | 284.5<br>286.1 | 396.0<br>400.8 |
| (4) oxidized W immersed in (3a) solution for 54 h | 30.7<br>32.5<br>34.2<br>36.3 | 529.7<br>531.9 | 284.5<br>285.6 | 396.1<br>397.9<br>400.9 |

TABLE 2

The peak area ratio for C, N, Cu, O, Cu(0) and Cu(+1) for various Cu samples

| Sample | C:N | Cu:O | Cu (0):Cu (+1) |
|---|---|---|---|
| (2a) solution on oxide-free Cu | 14:2 | 1:0.05 | 1:0.42 |
| (2a) solution on oxidized Cu | 19:2 | 1:0.11 | 1:0.68 |
| (3a) solution on oxide-free Cu | 14:2 | 1:0.07 | 1:0.32 |
| (3a) solution on oxidized Cu | 14:2 | 1:0.07 | 1:0.34 |

TABLE 3A

Mass spectrometry results from Cu testing, compounds and their molecular weight detected by mass spectrometry

| Compound | Molecular weight |
|---|---|
| 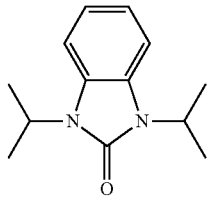 | 218.15 |

TABLE 3A-continued

Mass spectrometry results from Cu testing, compounds and their molecular weight detected by mass spectrometry

| Compound | Molecular weight |
|---|---|
| 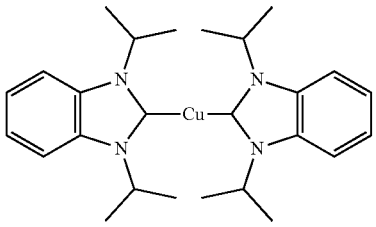 | 467.27 |

TABLE 3B

Mass spectrometry results from W testing, compounds and their molecular weight detected by mass spectrometry

| Compound | Molecular weight |
|---|---|
| 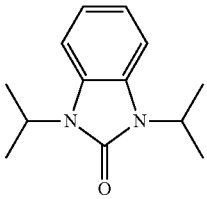 | 218.15 |

TABLE 4

Structural Formulae of Compounds that include N-Heterocyclic Carbene

| Nickname | Name | Structure |
|---|---|---|
| (1a) | 1,3-Diisoproplyl-benzimidazolium iodide | 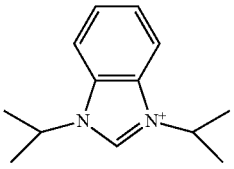 |
| (1b) | 1,3-dimethylbenz-imidazolium iodide | 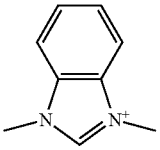 |

TABLE 4-continued

Structural Formulae of Compounds that include N-Heterocyclic Carbene

| Nickname | Name | Structure |
|---|---|---|
| (1d) | 5-(Dodecyloxy)-1,3-diisopropy1-1H-benzo[d]imidazol-3-ium iodide | 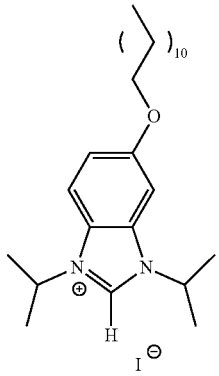 |
| (2a) | 1,3-Dihydro-1,3-bisisopropy1-2H-benzimidazol-2-ylidene | 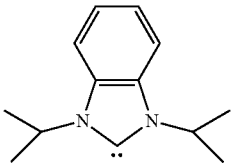 |
| (3a) Diisopropyl NHC | 1,3-dihydro-1,3-bisisopropylbenzo[d] imidazolium hydrogen carbonate | 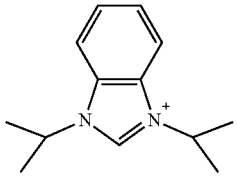 |
| (3b) Dimethyl NHC | 1,3-Dimethylbenz-imidazolium hydrogen carbonate, | 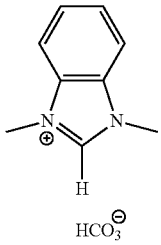 |
| (3d) | 5-(Dodecyloxy)-1,3-diisopropyl-1H-benzo[d] imidazol-3-ium hydrogen carbonate | 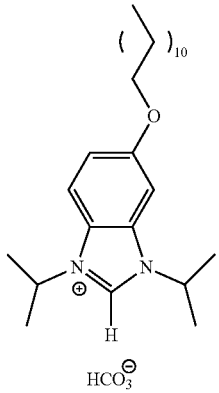 |

TABLE 4-continued

| Structural Formulae of Compounds that include N-Heterocyclic Carbene | | |
|---|---|---|
| Nickname | Name | Structure |
| dibenzylNHC | 1,3-dibenzyl-1H-benzo[d]imidazol-3-ium hydrogen carbonate | 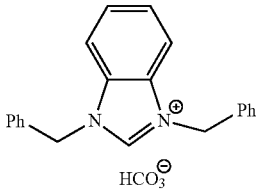 |

We claim:

1. A method of etching metal oxide from a metallic surface, comprising contacting the metal oxide with an etchant comprising:

a compound of general formula (II), (IIa), (III), (IIIa), (IV), (IVa) or (VI)

(II)

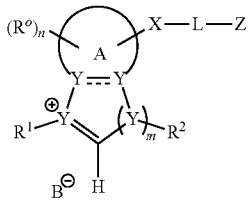

(IIa)

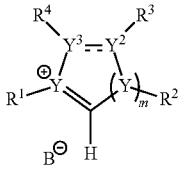

(III)

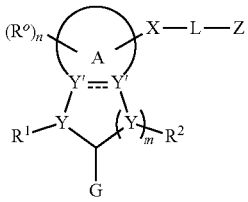

(IIIa)

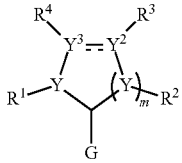

(IV)

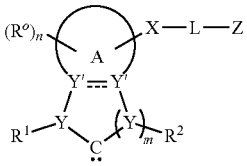

(IVa)

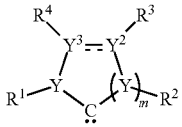

-continued (VI)

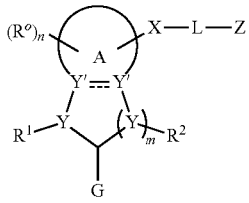

wherein:

n is an integer from 1 to 8;

m is an integer from 0 to 4;

A is absent, an aliphatic cycle, a heterocycle, an aromatic ring, a fused aromatic ring system, a heteroaromatic ring, and/or a fused heteroaromatic ring system, each of which is optionally substituted;

B is a counter ion that optionally acts as a base;

G is a perhalogenated alkyl, perhalogenated alkenyl, perhalogenated alkynyl, a perhalogenated aryl, or OR', wherein R' is an aliphatic group;

Y, Y', $Y^2$ and $Y^3$ are independently C or a heteroatom, and the dashed line is an optional double bond;

each $R^o$ is independently H, halogen, the substituent X-L-Z as defined above, $C_1$-$C_{10}$ alkyl, $C_{10}$-$C_{20}$ alkyl, $C_1$-$C_{10}$ alkenyl, $C_{10}$-$C_{20}$ alkenyl, $C_1$-$C_{10}$ alkynyl, $C_{10}$-$C_{20}$ alkynyl, $C_1$-$C_{10}$ alkoxyl, $C_{10}$-$C_{20}$ alkoxyl, $C_3$-$C_{20}$ cyclic aliphatic moiety, aryl, heteroaryl, ether, thioether, amine, polyamine, polyether, or polythioether, each of which is optionally substituted; or, two of $R^o$, together with the atoms to which they are attached, are connected to form a cycle, heterocycle, or an N-heterocyclic carbene precursor, each of which is optionally substituted;

$R^1$ and $R^2$ are independently absent, at least one lone pair of electrons, H, $C_1$-$C_{10}$ alkyl, $C_{10}$-$C_{20}$ alkyl, branched $C_3$-$C_{10}$ alkyl, $C_{10}$-$C_{20}$ alkenyl, $C_1$-$C_{10}$ alkynyl, or $C_{10}$-$C_{20}$ alkynyl), $C_3$-$C_{20}$ cyclic aliphatic moiety, aryl, heteroaryl, ether, thiol, thioether, amine, polyamine, polyether, polythioether, or polythiol, each of which is optionally substituted; or, one of $R^1$ or $R^2$, with one of $R^o$, together with the atoms to which they are attached, are connected to form a cycle, or heterocycle, each of which is optionally substituted;

$R^3$ and $R^4$ are independently H, halogen, the substituent X-L-Z as defined for Formula II, $C_1$-$C_{10}$ alkyl, $C_{10}$-$C_{20}$ alkyl, $C_1$-$C_{10}$ alkenyl, $C_{10}$-$C_{20}$ alkenyl, $C_1$-$C_{10}$ alkynyl, $C_{10}$-$C_{20}$ alkynyl, $C_1$-$C_{10}$ alkoxyl, $C_{10}$-$C_{20}$ alkoxyl, $C_3$-$C_{20}$ cyclic aliphatic, aryl, heteroaryl, ether, thioether, amine, polyamine, polyether, or polythioether, each of which is optionally substituted; or, any one of $R^3$ or $R^4$, with any one of $R^1$ or $R^2$, together with the atoms to which they are attached, are connected to form a cycle, or heterocycle, each of which is optionally substituted;

X-L-Z is absent, or

X is C or a heteroatom;

L is a divalent moiety, $C_1$-$C_{10}$ alkylene, $C_{10}$-$C_{20}$ alkylene, $C_1$-$C_{10}$ alkenylene, $C_{10}$-$C_{20}$ alkenylene, $C_1$-$C_{10}$ alkynylene, $C_{10}$-$C_{20}$ alkynylene, or dextran, a simple sugar, complex sugar, carbohydrate, ether, thioether, amine, polyamine, polyether, and/or polythioether, each of which is optionally substituted;

Z is H, an aliphatic cycle, a heterocycle, an aromatic ring, a fused aromatic ring system, a heteroaromatic ring, a fused heteroaromatic ring system, an organometallic complex, a transition-metal catalyst, a metal-oxide catalyst, a simple sugar, a complex sugar, a carbohydrate, or a chemically derivatizable group, OH, azide, carboxylic acid, carbonyl chloride, anhydride, ester, aldehyde, alcohol, amine, halogen, epoxide, thiirane, aziridine, amino acid, nucleic acid, alkene, alkyne, conjugated diene, thiol, or thioester, each of which is optionally substituted; and a solvent that solvates the compound of general formula (II), (IIa), (III), (IIIa), (IV), (IVa) or (VI), wherein the metallic surface comprises metal oxide; metal oxide and metal; metal oxide and metal alloy; or metal oxide, metal, and metal alloy, and wherein, when in contact with the metallic surface, the etchant etches metal oxide.

2. The method of claim 1, wherein the metallic surface comprises copper, tungsten, and/or silver.

3. The method of claim 1, wherein the etchant is a solid.

4. The method of claim 1, wherein the contacting the metal oxide is a solution phase process.

5. The method of claim 1, wherein the contacting the metallic surface is a vapour phase process.

6. The method of claim 1, wherein the compound of general formulas (II), (IIa), or (IVa) is:

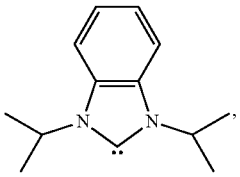

,

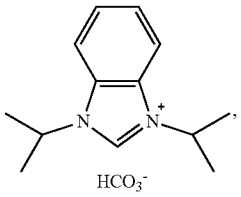

,

-continued

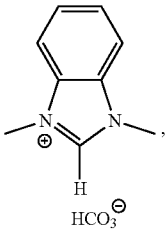

,

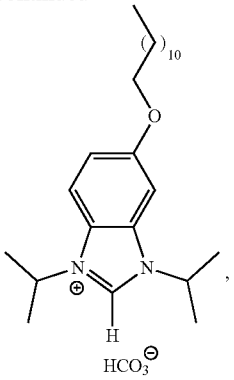

, or

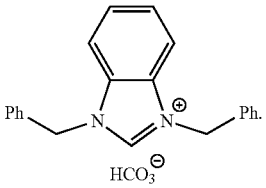

* * * * *